US006932469B2

(12) United States Patent
May et al.

(10) Patent No.: US 6,932,469 B2
(45) Date of Patent: Aug. 23, 2005

(54) IMAGING USING A COAGULABLE INK ON AN INTERMEDIATE MEMBER

(75) Inventors: John Walter May, Rochester, NY (US); Arun Chowdry, Pittsford, NY (US); Thomas Nathaniel Tombs, Brockport, NY (US)

(73) Assignee: Eastman Kodak Company, Rochester, NY (US)

( * ) Notice: Subject to any disclaimer, the term of this patent is extended or adjusted under 35 U.S.C. 154(b) by 550 days.

(21) Appl. No.: 09/973,228

(22) Filed: Oct. 9, 2001

(65) Prior Publication Data

US 2003/0066751 A1 Apr. 10, 2003

(51) Int. Cl.[7] ..... B41J 2/01

(52) U.S. Cl. ..... 347/103; 204/483; 204/486; 204/508

(58) Field of Search ..... 204/486, 483, 204/508; 347/103

(56) References Cited

U.S. PATENT DOCUMENTS 5,805,191 A * 9/1998 Jones et al. ..... 347/103
6,196,674 B1 * 3/2001 Takemoto ..... 347/103
6,682,189 B2 * 1/2004 May et al. ..... 347/103
6,719,423 B2 * 4/2004 Chowdry et al. ..... 347/103

* cited by examiner

*Primary Examiner*—Kishor Mayekar
(74) *Attorney, Agent, or Firm*—Lawrence P. Kessler

(57) ABSTRACT

Apparatus and method of making an ink-jet-ink-derived material image on a receiver. An ink jet device is used to form a coagulable ink image on a member, the ink image including a coagulable marking ink and a non-marking ink. Each smallest resolved imaging area of the ink image includes a predetermined mixed volume of the coagulable marking ink and the non-marking ink, the predetermined mixed volume being coagulable. Coagulates are formed within the coagulable ink image, and excess liquid is removed from the coagulates to form an ink-jet-ink-derived material image. The ink-jet-ink-derived image is transferred from the operational surface of the intermediate member to another member, which another member may be a receiver member, a drum or a web.

57 Claims, 8 Drawing Sheets

FIRST INK DROPLETS DEPOSITED

SECOND INK DROPLETS DEPOSITED

INTERMIXED FIRST AND SECOND INKS

CORONA-CHARGED
TWO-FLUID
PRIMARY IMAGE

TWO-FLUID
PRIMARY IMAGE

IMAGING USING A COAGULABLE INK ON AN INTERMEDIATE MEMBER

CROSS-REFERENCE TO RELATED APPLICATIONS

Reference is made to the following commonly-assigned copending applications:

U.S. patent application Ser. No. 09/973,239, now U.S. Pat. No. 6,719,423 entitled INK JET PROCESS INCLUDING REMOVAL OF EXCESS LIQUID FROM AN INTERMEDIATE MEMBER by Arun Chowdry, et al., and, U.S. patent application Ser. No. 09/973,244, now U.S. Pat. No. 6,682,189 entitled INK JET IMAGING VIA COAGULATION ON AN INTERMEDIATE MEMBER by John W. May, et al., concurrently filed herewith, the disclosures of which are incorporated herein.

FIELD OF THE INVENTION

The invention relates in general to digital image recording and printing in an apparatus including an ink jet device for forming an ink image on a member. In particular, a first ink and a second ink are used in the ink jet device wherein at least one of the first and second inks is a coagulable ink, an electric field is applied to the ink image on the intermediate member to form a concentrated image, excess liquid is removed from the concentrated image, and the residual image is subsequently transferred to a receiver.

BACKGROUND OF THE INVENTION

An imaging method and apparatus involving electrocoagulation of a primarily aqueous dispersion has been disclosed by the Castegnier et al. patents (e.g., U.S. Pat. Nos. 3,892,645, 4,555,320, 4,661,222, 4,895,629, 5,538,601, 5,609,802, 5,693,206, 5,727,462, 5,908,541 and 6,045,674) wherein an electric current is passed between a positive electrode (or an array of positive electrodes) and a negative electrode (in an array of negative electrodes) to produce an electrocoagulated deposit on the positive electrode. An imagewise electrocoagulated deposit may be transferred to a receiver such as paper to form a single color image, e.g., a black image, on the paper. Alternatively, imagewise electrocoagulated deposits of different colors may be sequentially deposited, e.g., on a positively biased belt, so as to form a full color image for subsequent transfer to a receiver. A squeegee blade apparatus for removing excess liquid is disclosed in the Castegnier et al. patents (U.S. Pat. Nos. 5,928,486 and 6,090,257). A difficulty inherent in the electrocoagulation technique is that image uniformity requires an extremely accurate distance between each pair of opposing positive and negative electrodes, typically about 50 micrometers. Moreover, the image resolution is limited by the diameter of individually addressable electrodes and also by the fact that these electrodes must be isolated from one another by a thickness of insulating material between them. There are other difficulties, e.g. that the electrical power density required for creating an electrocoagulated image is relatively high, that special materials are needed to suppress unwanted gas generation near the electrodes, and that electrodes must be protected against electrolytic erosion. The Castegnier et al. patent (U.S. Pat. No. 4,555,320) discloses a relatively low resolution of 200 dots per inch requiring 25 watts of power (50 volts, 500 ma) to produce 100,000 developed dots per second, which is equivalent to about 100 microcoulombs of charge delivered in about 0.4 second per developed dot, resulting in a significant power density of about 4.1 watts/in$^2$ if every imaging pixel is developed (maximum density flat field image). The Castegnier patent (U.S. Pat. No. 4,764,264) discloses a resolution of 200 dots per inch requiring 25 watts of power to produce 1,000,000 developed dots per second, each developed dot requiring passage of 25 microcoulombs of charge.

In related copending U.S. patent application Ser. No. 09/973,244, now U.S. Pat. No. 6,682,189 entitled Ink Jet Imaging Via Coagulation On An Intermediate Member by John W. May, et al., the contents of which are incorporated herein by reference, certain embodiments are disclosed for using an ink jet device to form an ink image on an intermediate member, which ink is an electrocoagulable ink. By jetting a predetermined variable number of droplets on each imaging pixel of an operational surface of the intermediate member, the resulting ink image on the intermediate member has a predetermined variable amount of coagulable ink per pixel. The ink image is moved into contact with an electrocoagulation member, which electrocoagulation member makes physical contact with the variable amounts of liquid of the ink jet image on the intermediate member. Passage of electric current between an electrode included in the electrocoagulation member and a sub-surface electrode included in the intermediate member results in passage of corresponding currents through the variable amounts of electrocoagulable ink, thereby causing an imagewise formation of coagulate deposits on the intermediate member. An excess liquid phase not included in the coagulate deposits is removed from the coagulate deposits while the coagulate deposits remain on the intermediate member, and the coagulate deposits are subsequently transferred to a receiver member. There are certain limitations, which may be associated with the above-described embodiments. These limitations include: (1) a difficulty associated with providing a small enough gap, between the operational surface of the intermediate member and the electrocoagulation member, so that every differing amount of electrocoagulable ink in the ink image can be contacted by the electrocoagulation member, i.e., so that electrocoagulation can occur efficiently at every imaging pixel where there is ink; (2) if, in fact, the gap is made thus sufficiently small, there is a difficulty with a possible blurring of the image as a result of a squashing of the larger amounts of the variable amounts of ink; (3) after the coagulate deposits are formed on the intermediate member, there is a difficulty in efficiently removing the corresponding variable amounts of excess liquid phase from the coagulate deposits; (4) owing to a varying thickness from pixel to pixel of the coagulate deposits, a high efficiency of transfer to a receiver of the thinnest of such deposits may be difficult to achieve.

In related copending U.S. patent application Ser. No. 09/973,239, now U.S. Pat. No. 6,769,423 entitled Ink Jet Process Including Removal Of Excess Liquid From An Intermediate Member by Arun Chowdry, et al., the contents of which are incorporated herein by reference, certain embodiments are disclosed for using an ink jet device to form a colloidal ink image on an intermediate member, which ink is nonaqueous colloidal dispersion of electrically charged pigmented particles in an insulating carrier liquid, similar to a liquid developer for use in electrostatography. By jetting a predetermined variable number of droplets on each imaging pixel of an operational surface of the intermediate member, the resulting colloidal ink image on the intermediate member has a predetermined variable amount of colloidal dispersion per pixel. In one of the disclosed embodiments, the colloidal ink image is moved into proximity with an electrode member, which electrode member makes physical contact with the variable amounts of liquid of the ink jet image on the intermediate member. An electric field applied between an electrode included in the electrocoagulation member and a sub-surface electrode included in the intermediate member urges the charged particles of the dispersion to form a concentrated image on the operational surface of the intermediate member. An excess carrier liquid not included in the concentrated image is removed from the concentrated image while the particles remain on the intermediate member, and the particles thus left behind on the operational surface are subsequently transferred to a receiver member. In other disclosed embodiments, the electrode member does not touch the ink image, and in yet other disclosed embodiments, a corona charging device is used to charge the variable amounts of liquid in the ink image, thereby producing internal electric fields within the variable amounts of liquid for urging the corresponding charged particles in each imaging pixel to migrate to the operational surface. There are certain limitations, which maybe associated with one or more of the above-described embodiments. These limitations include: (1') a difficulty associated with providing a small enough gap, between the operational surface of the intermediate member and a contacting electrode member, so that every differing amount of ink in the ink image can be contacted by the contacting electrode member, i.e., so that particle migration can occur efficiently at every imaging pixel where there is ink; (2') if, in fact, the gap is made thus sufficiently small, there is a difficulty with a possible blurring of the image as a result of a squashing of the larger amounts of the variable amounts of ink; (3') after the concentrated image is formed on the intermediate member, there is a difficulty in efficiently removing the corresponding variable amounts of excess carrier liquid; (4') owing to a varying thickness from pixel to pixel of the deposits of migrated particles, a high efficiency of transfer to a receiver of the thinnest of such deposits may be difficult to achieve.

SUMMARY OF THE INVENTION

The invention provides a digital imaging method and apparatus including: an ink jet device which includes a first source of ink for imagewise delivering predetermined variable amounts of a first ink and a second source of ink for imagewise delivering predetermined variable complementary amounts of a second ink, of which first and second inks at least one is a coagulable marking ink; an intermediate member having an operational surface upon which a coagulable primary ink jet image is formed from the first and second inks by ink droplets produced by the ink jet device; a mechanism to cause a formation of coagulates in the coagulable primary ink jet image; a liquid removal mechanism for removing excess liquid from the coagulates; a transfer mechanism for transferring liquid-depleted coagulates to a receiver member so as to form an ink-jet-ink-derived material image on the receiver member; and, a regeneration mechanism for regenerating the operational surface prior to forming a new primary image thereon. The first and second inks include nonaqueous colloidal dispersions, aqueous-based colloidal dispersions, and electrocoagulable inks.

In one aspect of the invention, the first ink is a dispersion of pigmented particles dispersed in a carrier liquid, and the second ink is made with a similar carrier liquid, which second ink contains substantially no particles. The predetermined amounts of the second ink become mixed with corresponding complementary amounts of the first ink on the operational surface of the intermediate member so as to form the coagulable primary image thereon. In alternative embodiments of this aspect of the invention, the second ink is made with unpigmented particles similarly dispersed in a similar carrier fluid, such that when the second ink becomes mixed with the first ink to form the primary image, imagewise complementary amounts of the unpigmented particles are included with the pigmented particles in the primary image. In a preferred embodiment of this aspect of the invention, the first ink is a nonaqueous colloidal dispersion of charged pigmented particles in an insulating carrier liquid, and the second ink is made with a similar nonaqueous insulating liquid, which second ink contains substantially no colloidal particles, such that imagewise variable complementary amounts of the second ink are included in the coagulable primary image. In a preferred alternative embodiment of this aspect of the invention, the second ink is made with unpigmented similarly charged particles similarly dispersed in a similar insulating carrier fluid, such that imagewise variable complementary amounts of the unpigmented particles are included in the primary image. In both of the above-described preferred embodiment and the above-described preferred alternative embodiment of this aspect of the invention, a preferred mechanism to cause a formation of coagulates is an electric field mechanism which causes charged colloidal particles in the primary image to migrate to the operational surface, on which operational surface are thereby formed coagulates of the colloidal particles; and, after excess liquid has been removed by the liquid removal mechanism, the liquid-depleted coagulates are transferred to the receiver member to form an ink-jet-ink-derived pigmented particulate image thereon. In other preferred alternative embodiments of this first aspect of the invention similarly utilizing a non-marking second ink which contains coagulable non-marking particles, the mechanism to cause a formation of coagulates includes: a mechanism for a heating or a cooling of the primary image on the intermediate member; a mechanism for adding a dissolved salt to the liquid of an aqueous-based primary image; a mechanism for altering the pH of the liquid of an aqueous-based primary image; a mechanism for causing a desorption or a decomposition of polymeric moieties adsorbed on sterically stabilized particles of a primary image; a mechanism for adding dissolved polymeric molecules to destabilize a sterically stabilized dispersion of a primary image; and, a mechanism for adding a hetero-colloid to form hetero-coagulates in a primary image.

In an other aspect of the invention, the first ink of a preferred embodiment is an electrocoagulable first ink containing a colorant, and the second ink is made with a similar fluid and which second ink contains substantially no electrocoagulable material. In a preferred alternative embodiment of this other aspect of the invention, the second ink is also a coagulable ink containing no added colorant, which coagulable second ink becomes mixed with the coagulable first ink to form the coagulable primary image. In the embodiments of this other aspect of the invention, an electrocoagulation member, included in an electrocoagulation mechanism, provides an electric field and a source of electrical current for imagewise forming, on the operational surface, electrocoagulates containing the colorant in an electrocoagulated image; and, after excess liquid has been removed by the liquid removal mechanism, an electrocoagulate liquid-depleted image is transferred to the receiver member to form a colored ink-jet-ink-derived electrocoagulate material image thereon.

In embodiments in which the coagulable primary image includes a nonaqueous colloidal dispersion of pigmented particles, the liquid removal mechanism is similar to any known mechanism for removing a carrier liquid from a liquid-developed toner image situated on an electrostatographic primary imaging member or intermediate transfer member.

BRIEF DESCRIPTION OF THE DRAWINGS

In the detailed description of the preferred embodiments of the invention presented below, reference is made to the accompanying drawings, in some of which the relative relationships of the various components are illustrated, it being understood that orientation of the apparatus may be modified. For clarity of understanding of the drawings, some elements have been removed, and relative proportions depicted or indicated of the various elements of which disclosed members are composed may not be representative of the actual proportions, and some of the dimensions may be selectively exaggerated.

DETAILED DESCRIPTION OF THE PREFERRED EMBODIMENTS

The invention provides an improved method and apparatus for ink jet imaging, the apparatus employing an ink jet device utilizing a coagulable ink. The ink jet device produces ink droplets according to a known manner for deposition on an intermediate member, which intermediate member has an operational surface upon which a primary ink jet image is formed by the ink jet device. The ink jet device includes a first source of ink for a first ink and a second source of ink for a second ink, of which first and second inks at least one is a marking coagulable ink jet ink. The first ink and the second ink are preferably both nonaqueous, or alternatively are preferably both aqueous-based. The liquid vehicle for an aqueous-based ink is usually water. However, an aqueous-based ink may contain a proportion, typically a minor proportion, of any suitable miscible nonaqueous solvent. In certain embodiments, the marking coagulable ink is a nonaqueous colloidal dispersion of pigmented particles in an insulating carrier liquid, and coagulates are made therefrom in the primary image by means of an applied electric field. In other embodiments, the marking coagulable ink is an electrocoagulable ink, from which colored coagulates are made in the primary image by a passage of an electrical current through the primary image. Preferably, coagulates are formed immediately adjacent or directly on the operational surface of the intermediate member. A liquid removing mechanism for removing excess liquid from the coagulates produces a liquid-depleted image on the intermediate member. Finally, a transfer mechanism is provided for transferring the liquid-depleted image from the intermediate member to a receiver member, and a regeneration mechanism is subsequently employed to regenerate the operational surface of the intermediate member prior to forming a new primary image thereon.

Figures 1A, 1B, 1C:
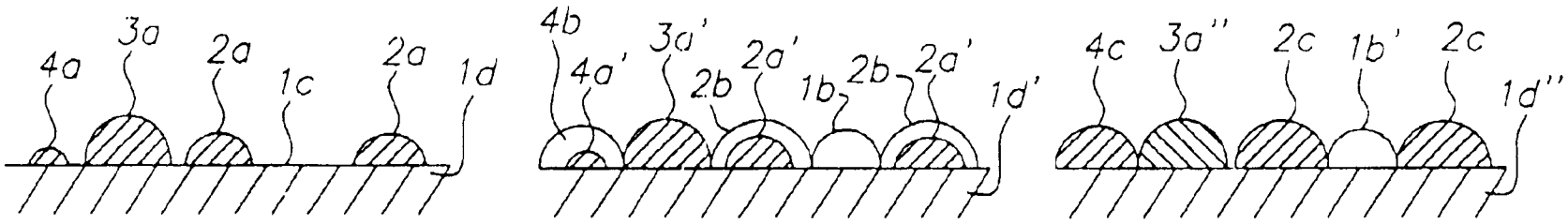
FIGS. 1*a,b,c* schematically depict a formation of a two-fluid primary ink jet ink image on an operational surface of an intermediate member according to the invention.

Referring now to the accompanying drawings, FIG. 1*a,b,c* schematically show formation of a primary ink jet image, which primary image includes a first liquid ink and a second liquid ink, of which first and second inks at least one is a marking coagulable ink jet ink. A marking ink is henceforth an ink that ultimately produces a color (including black) on a receiver member. FIG. 1*a* is a sketch of a portion of a digitally formed image made of the first ink deposited on the intermediate member by the first source of ink, which image has a gray scale such that individual imaging pixels are shown to contain variable quantities of the first ink deposited on the operational surface, indicated by the numeral 1*c*, of the intermediate member, 1*d*. As is well known, such a variation in the amount of liquid can be produced by an imagewise delivery of multiple ink droplets per pixel. For example, an as-deposited amount labeled 3*a* is formed by a greater number of droplets than an amount labeled 2*a* on an adjacent pixel, while the amount labeled 2*a* is greater than the amount labeled 4*a*. Between the two amounts labeled 2*a* there is a shown a bare pixel containing no ink. To produce a gray scale, an imaging pixel of the primary image may have zero ink deposited, or a pixel may contain a plurality of droplets, e.g., as many as twenty or more droplets of a marking ink per pixel to achieve maximum image density, as is known in the art. As is also well known, ink jet ink droplets having a variable size may be created by an ink jet device, thereby providing an alternate way of creating a gray scale.

FIG. 1*b* illustrates schematically the result of imagewise depositing predetermined amounts of the second ink, from the second ink jet source of ink, on an imagewise deposit of the first ink, where the first ink portions are shown as hatched and the second ink portions are shown as clear. In FIG. 2*b*, the single primed (') entities correspond to those of FIG. 1*a*, and as indicated in the drawing, amounts of the second ink shown as 2*b* and 4*b* are respectively associated with amounts 2*a*' and 4*a*' of the first ink, with amount 2*b* smaller than amount 4*b*. Amount 1*b* of the second ink, located on the previously bare pixel in FIG. 1*a*, is greater than amount 4*b*, and amount 4*b* is greater than the amount 2*b*. The first and second inks are preferably mutually miscible, and more preferably the first and second inks are made of similar liquids. Generally, the subject invention includes sequential or concurrent depositions of the marking and non-marking inks, i.e., in any pixel of the primary image, one or another of the following occurs: all of the marking ink arrives first; all of the non-marking ink arrives first; the arrivals of the two inks overlap partially in time; or, the time periods of arrival of both marking and non-marking inks overlap substantially completely. In preferred embodiments of inks, total volume is conserved when any amounts of each of the first and second inks are mixed together, i.e., the total volume is the sum of the individual volumes. Moreover, in preferred embodiments of inks both the first ink and the second ink are substantially insoluble in, and substantially nonabsorbable by, the intermediate member 1*c*. However, the invention is not limited to such preferred first and second inks, and in particular, total volume may not be conserved when amounts of the first and second inks are mixed. For purpose of illustration, let it be assumed that the first ink (shown for example as hatched in FIG. 1*b*) is a marking coagulable ink from which colored coagulates may be formed, and let it also be assumed that the second ink (shown for example as unhatched in FIG. 1*b*) produces no color. Henceforth, an ink which produces no color, i.e., which is substantially colorless, or which includes no added colorant nor forms a colorant, is referred to as a non-marking ink. Let it be further assumed that volume is conserved when amounts of these first and second inks of FIG. 1*b* are mixed. For each pixel in an imaging area on the operational surface, a total amount of liquid per pixel in FIG. 1*b* contains a first number of droplets, P, of the first ink, and a second number of droplets, Q, of the second ink, and the total number of droplets in each pixel, N, is given by N =P +Q. Let it be assumed for purpose of illustration that N is the same for every pixel of a primary image. Then, as shown in FIG. 1*b*, it follows that if an amount 3*a*' of the marking first ink is the largest predetermined amount of the first ink delivered to any pixel, then in a resulting final image on a receiver, this largest predetermined amount corresponds to a maximum achievable density, Dmax. In association with the amount of marking ink 3*a*', there is shown no added amount of the non-marking second ink, i.e., Q =0, so that the amount 3*a*' is equal to N, i.e., P =N. Similarly, there is no marking ink associated with the amount of non-marking second ink labeled 1*b*, so that P =0 and Q =N, and the amount 1*b* corresponds to a minimum achievable final image density, i.e., Dmin. It is preferred, as indicated in the example illustration of FIG. 1*b*, that N represents a substantially constant total number of droplets delivered by both the first and second sources of ink to each of the imaging pixels, and this will be the case when volume is conserved upon mixing, as was assumed for the above discussion. However, in certain embodiments, it may be desirable for N not to be substantially constant for all pixels in a primary image, but alternatively that N has a functional dependence, e.g., a linear dependence, on the number of droplets of marking ink used per pixel. It is also preferred, as illustrated in FIG. 1*b*, that pixels corresponding to the maximum achievable density in an image contain only the marking coagualable ink and no component of the non-marking ink. However, in certain other embodiments, a constant number, R, of extra droplets of the non-marking ink may be delivered to each pixel. For example, assuming N in certain embodiments to be constant for all pixels, the total number of droplets per pixel, N +R, is therefore also constant, with N including, as described above, respective numbers of droplets P and Q of the marking and non-marking inks, and with Q +R being the total number of non-marking droplets per pixel.

Generally, it will be evident that complementary numbers of marking and non-marking particles are included in each pixel of a primary image, or equivalently, complementary numbers of droplets of marking ink and droplets of non-marking ink are used per pixel. For such embodiments, the term "complementary" means that as a number of droplets of a marking ink delivered per pixel, say W, is made larger, a complementary number of droplets, say X, of a non-marking ink delivered to the same pixel is made correspondingly smaller, and preferably, as described above, the corresponding sum (W +X) is substantially constant for every pixel of the primary image. Alternatively, in other embodiments, the term "complementary" may refer to respective volumes of the marking and non-marking inks deposited in a pixel of a primary image. In these other embodiments, a volume including a number of droplets, Y, of a marking ink becomes mixed in a given pixel with a complementary volume including a number of droplets, Z, of a non-marking ink, such that a resulting total volume per pixel resulting from the mixing of the (Y +Z) droplets is preferably substantially constant for all pixels of the primary image.

FIG. 1*c* shows the result of an intermixing of the first and second inks, in each imaging pixel, so as to form a primary image on the intermediate member. The single primed (') entities correspond to those of FIG. 1*a*, and the double primed entities (") correspond to those of FIG. 1*b*. The degrees of hatching represent relative amounts of the marking ink included in the pixels, with the heaviest hatching representing the maximum achievable density in a final image on a receiver. Although for simplicity of exposition only two levels of hatching are illustrated in FIG. 1*c*, it will be henceforth understood in the described embodiments that for high quality imaging there will be many density level differences between Dmin and Dmax, with pixels containing corresponding proportions of marking ink to create these density level differences. In a preferred embodiment, the volumes of liquid in each imaging pixel of the primary image is substantially the same. If, however, in certain embodiments total volume is not conserved when intermixing takes place, it will be evident that the total number of droplets delivered to a pixel will need to vary, depending on the quantity of marking ink delivered to a given pixel. Thus, in order to provide a same total volume of liquid on each pixel after intermixing, the sum of P +Q will not be a constant in such a case, and will vary from pixel to pixel, with the individual predetermined numbers of droplets P and Q properly adjusted imagewise so as to account for any volume change upon intermixing of the two fluids of the marking and non-marking inks. It is a prerequisite of the subject invention that any intermixed liquid on any pixel of the primary image that contains a proportion of a coagulable ink is also coagulable, which proportion includes a first ink and a second ink delivered respectively by the first source of ink and the second source of ink.

Figure 1D:
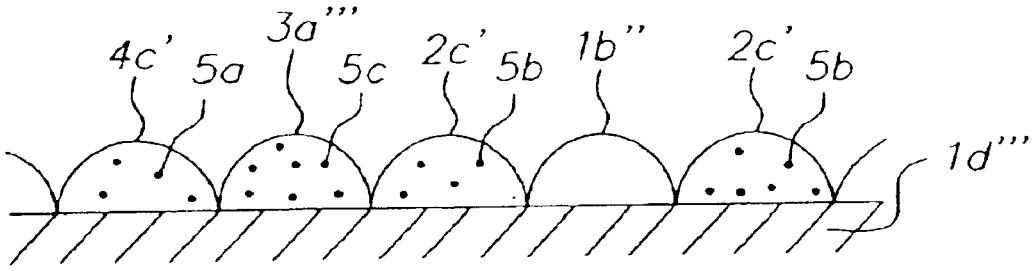
FIG. 1*d* schematically depicts in more detail an embodiment of an intermixed two-fluid primary ink jet ink image corresponding to FIG. 1*c*, in which embodiment the image is made from an ink jet ink containing pigmented charged particles.

FIG. 1*d* illustrates a preferred embodiment of a primary image corresponding to FIG. 1*c*, wherein the marking ink is a colloidal dispersion of pigmented particles, and each of the single primed (′), double primed (″) and triple primed (‴) entities refers to a corresponding entity labeled with one less prime in FIG. 1*c*. The liquid in a given pixel contains a plurality, including zero, of the pigmented particles. Thus, in the liquid 1*b*″, there are no pigmented particles. The liquids 4*c*′, 2*c*′, and 3*a*‴, respectively contain pluralities 5*a*, 5*b*, and 5*c*, of the pigmented particles, plurality 5*c* being larger than 5*b*, and 5*b* larger than 5*a*. Any non-marking ink included in the liquids 1*b*″, 4*c*′, 2*c*′, and 3*a*‴ contains substantially no particles, and is preferably colorless.

Figure 1E:
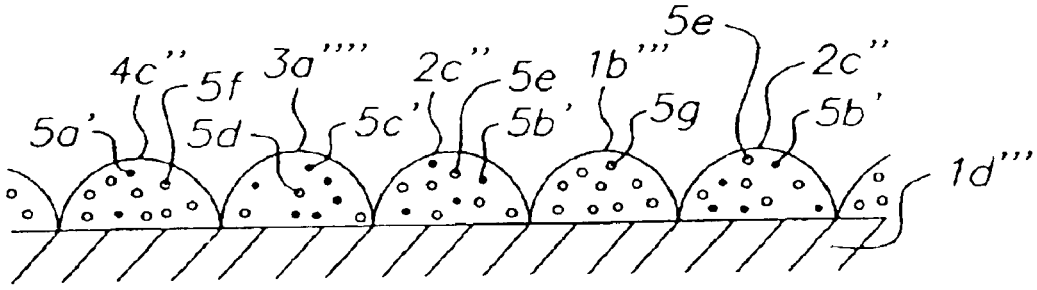
FIG. 1*e* schematically depicts in more detail an alternative embodiment of an intermixed two-fluid primary ink jet ink image corresponding to FIG. 1*c*, in which alternative embodiment the image is made from an ink jet ink containing pigmented charged particles and another ink jet ink containing unpigmented charged particles.

FIG. 1*e* illustrates a preferred embodiment of a primary image corresponding to FIG. 1*c*, i.e., after intermixing of the marking and non-marking inks has occurred, wherein the marking ink is a dispersion, preferably a colloidal dispersion, of pigmented particles in a first carrier liquid and the non-marking ink is a dispersion, preferably a colloidal dispersion, of unpigmented particles in a second carrier liquid. The marking and non-marking dispersions are preferably similar to one another. Thus, except for any added pigmentation or other added coloration, the marking and non-marking particles are preferably made from similar materials. Also, it is preferred that any colloidal stabilizations of the marking and non-marking dispersions are similar and preferably identical. Further, it is preferred that the first and second carrier liquids are similar and preferably identical. Each of the single primed (′), double primed (″), triple primed (‴), and quadruple primed (⁗) entities refers to a corresponding entity labeled with one less prime in FIG. 1*d*. The liquid in a given pixel contains a plurality, including zero, of the pigmented particles. Thus, in the liquid 1*b*‴, there are no pigmented particles. The liquids 4*c*″, 2*c*″, and 3*a*⁗, respectively contain pluralities 5*a*′, 5*b*′, and 5*c*′, of the pigmented particles, plurality 5*c*′ being larger than 5*b*′, and 5*b*′ larger than 5*a*′. Corresponding complementary pluralities of unpigmented particles from the non-marking ink are included in the liquids 3*a*⁗, 2*c*″, 4*c*″, and 1*b*′, which pluralities of unpigmented particles are respectively labeled 5*d*, 5*e*, 5*f*, and 5*g*, where plurality 5*g*>plurality 5*f*>plurality 5*e* >plurality 5*d*. Moreover, in a most preferred embodiment, the total number of particles of dispersion in each pixel, including the pigmented and the unpigmented particles, is substantially constant, as indicated schematically in FIG. 1*e*. Also, in a most preferred embodiment, each of the amounts of liquid, 1*b*‴, 4*c*′, 2*c*′, and 3*a*⁗ has substantially the same volume. Generally, a co-coagulate is formed from the pigmented particles and the unpigmented particles included in any intermixed inks contained in a given imaging pixel of a primary image on the operational surface. Preferably, such a co-coagulate, formed adjacent the operational surface of the intermediate member 1*d*⁗, is a uniform mixture of the pigmented and unpigmented particles contained in the given pixel. However, in certain embodiments, it may be preferred that a stratified co-coagulate material or a nonuniformly mixed co-coagulate material be formed adjacent the operational surface of the intermediate member 1*d*⁗, and this may be made to happen by for example respectively providing different electrophoretic mobilities for the pigmented and unpigmented particles. Moreover, in certain other embodiments, it can be advantageous to deliver from the ink jet device to each pixel of the primary image an extra number of droplets of the non-marking unpigmented particulate ink, for subsequent improvements of fusing and image gloss properties as described more fully below.

In another embodiment (not illustrated) an electrocoagulable marking ink is utilized in a primary image (instead of the colloidal dispersion of marking particles shown in FIG. 1*d*) and the primary image contains imagewise-varying complementary quantities of a marking electrocoagulable ink and a non-marking ink, the non-marking ink containing for example no coagulable material, by analogy with FIG. 1*d*. In a similar fashion to the previous embodiments, the total volume of liquid is made substantially the same in each imaging pixel of the primary image, which total volume includes both any marking electrocoagulable ink and any preferably miscible intermixed non-marking ink. This is accomplished by delivering from the first and second sources of ink an appropriate number of droplets of each of the first and second inks, so as to produce a constant volume of liquid per imaging pixel, which volume per pixel contains any required proportion of the marking electrocoagulable ink.

In another embodiment (not illustrated) a marking electrocoagulable coagulable ink and a non-marking electrocoagulable ink are used to jointly form a primary image, the non-marking coagulable ink containing a coagulable material by analogy with FIG. 1*d*. Thus, the marking electrocoagulable ink provides a colored electrocoagulate component deposited on the operational surface of the intermediate member, and the non-marking electrocoagulable ink provides a complementary amount of co-deposited, substantially uncolored, electrocoagulate. Preferably, in each imaging pixel an amount of colored electrocoagulate and a complementary amount substantially uncolored electrocoagulate together form an intimately mixed co-electrocoagulate on the operational surface. In this other most preferred embodiment, in similar fashion to the embodiments of FIG. 1, the total volume of liquid is made substantially the same in each imaging pixel of the primary image, which total volume per pixel includes both any marking electro-coagulable ink and any intermixed preferably miscible non-marking electro-coagulable ink. This is accomplished by delivering from the first and second sources of ink an appropriate number of droplets of each of the first and second electrocoagulable inks per pixel, so as to produce in a constant total volume per pixel of the primary image a required predetermined proportion of the marking electrocoagulable coagulable ink. Generally, according to the invention, a coelectrocoagulate is formed adjacent the operational surface in any given imaging pixel. Preferably, such a co-electrocoagulate is a uniform mixture of the marking and non-marking electrocoagulates contained in the given pixel. However, in certain embodiments, a stratified co-electrocoagulate material or a nonuniformly mixed co-electrocoagulate material may be usefully formed adjacent the operational surface of the intermediate member.

Figure 2:
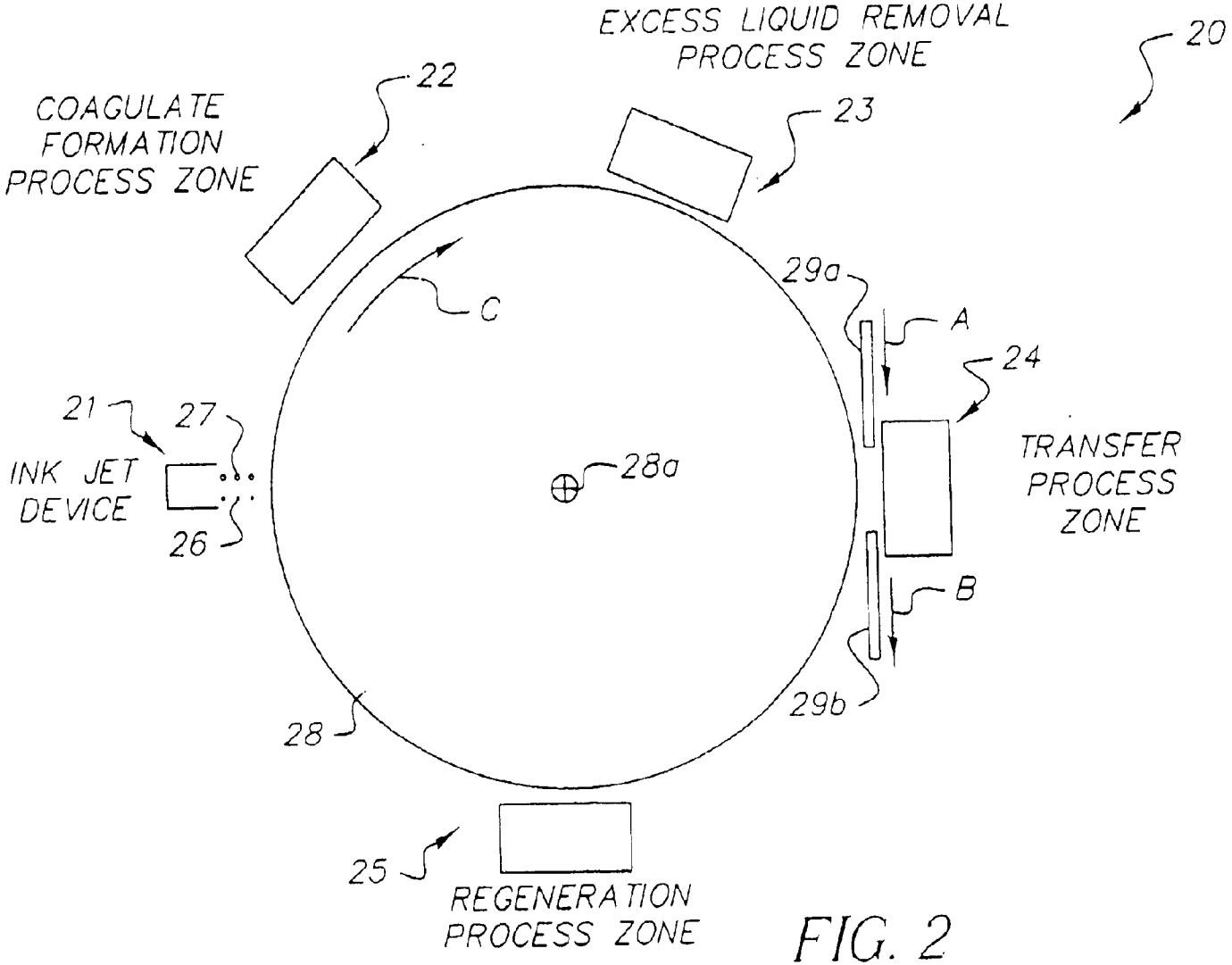
FIG. 2 is a schematic side elevational view of a generalized embodiment of an apparatus of the invention showing both specific and generalized components, thereof.

FIG. 2 shows a preferred embodiment of a ink jet imaging apparatus for creating gray scale images according to the invention. The imaging apparatus, designated generally by the numeral 20, includes: an ink jet device 21 for depositing ink droplets 26 and 27 to form a primary ink jet image on the operational surface of an intermediate member roller 28 mounted on shaft 28*a* rotating in a direction of an arrow labeled C, a Coagulate Formation Process Zone 22 for forming coagulates in the primary image, an Excess Liquid Removal Process Zone 23 for forming a liquid-depleted material image, a Transfer Process Zone 24 for transferring the liquid-depleted material image from roller 28 to a receiver member, and a Regeneration Process Zone 25 for preparing the intermediate member for a fresh primary image. A receiver sheet 29*a*, moving in a direction of arrow A, is shown approaching Transfer Process Zone 24. A receiver sheet 29*b* is shown leaving the Transfer Process Zone in a direction of arrow B. Receiver 29*b* carries a liquid-depleted material image derived from a primary ink jet image previously formed by ink jet device 21 on intermediate member 28, which liquid-depleted material image is transferred in Process Zone 24 from intermediate member 28 to a receiver, e.g., receiver 29*b*. Intermediate member roller 28 may be rotated by a motor drive applied to shaft 28*a*, or alternatively by a frictional drive produced by a frictional engagement with another rotating member (not shown).

In an alternate embodiment, intermediate member 28 may be in the form of an endless web onto which is deposited a primary ink jet image by ink jet device 21, which web is driven or transported past or through the various Process Zones 22, 23, 24 and 25. The liquid-depleted material image is transferred from the web to a receiver member in Transfer Process Zone 14.

Coagulate Formation Process Zone 22, Excess Liquid Removal Process Zone 23, Transfer Process Zone 24 and Regeneration Process Zone 25 may include the use of rotatable elements. The rotatable elements of the subject invention are shown as both rollers and webs in the examples of this description but may also include drums, wheels, rings, cylinders, belts, loops, segmented platens, platen-like surfaces, and receiver members, which receiver members include receiver members moving through nips or adhered to drums or transport belts.

The ink jet device 21 may include any known apparatus for jetting droplets of a liquid ink in a controlled imagewise fashion on to the operational surface of intermediate member (IM) 28, with digital electronic signals controlling in known manner a variable number of droplets delivered to each imaging pixel on the operational surface. A primary image made on the operational surface by the liquid ink droplets 26, 27 may be a continuous tone image, or it may be a half-tone image including gray-level half-tones, frequency modulated half-tones, area-modulated half-tones and binary halftones as are well known in the art. The conventional and well-known terms "continuous tone" and "half-tone" refer here not only to any place-to-place variations of the quantity of either of the marking or non-marking inks within the image on the operational surface, but also to any corresponding color or density that may subsequently be produced or induced in imagewise fashion by these same variations of the quantity of either ink. An imaging pixel is defined in terms of the image resolution, such that if the resolution were, say, 400 dots per inch (dpi), then a square pixel for example would occupy an area on the operational surface having dimensions of 63.5 $\mu$m×63.5 $\mu$m. Thus, an imaging pixel is a smallest resolved imaging area in a primary image. The operational surface of IM 28 includes any portion of the surface of the intermediate member upon which a primary ink jet image may be formed by ink jet device 21.

The ink jet device 21 includes a continuous ink jet printer and a drop-on-demand ink jet printer including a thermal type of ink jet printer, a bubble-jet type of ink jet printer, and a piezoelectric type of ink jet printer. A drop-on-demand ink jet printer is preferred. The ink jet device 21 includes a first source (not illustrated) of a first ink and a second source (not illustrated) of a second ink, at least one of which first ink and second ink is a coagulable ink. Furthermore, one of the first ink and the second ink is a preferably marking ink and the other is preferably a non-marking ink. On any pixel of the primary image, preselected numbers of droplets of the first and second inks are deposited, e.g., sequentially or concurrently, from the first and second sources. Thus, for a sequential deposition of the two inks on a given pixel of the primary image on the operational surface, all of a preselected number of droplets of a marking ink, e.g., droplets 26 may arrive before any of a complementary preselected number of droplets 27 of a non-marking ink, or vice versa. Alternatively, the times of arrival of the first and second inks on a given pixel may partially overlap, or, the first and second inks may arrive on a given pixel during substantially the same period of time. Moreover, the ink jet device 21 may include both the first source of ink and the second source of ink located in a same unit of apparatus, or, the first and second sources may be located in two distinct units of apparatus, e.g., arranged tandemly.

Each of the first and second sources of ink in ink jet device 21 is typically included in a writehead (not shown) which includes a plurality of electronically controlled individually addressable jets, which plurality may be disposed in a full-width array, i.e., along the operational width of roller 28 in a direction parallel to the axis of shaft 28*a*. Alternatively, as is well known, the writehead may include a relatively smaller array of jets and the writehead is translated back and forth in directions parallel to the axis of shaft 28*a* as the operational surface of roller 28 rotates. The inks used by the ink jet device 21 are provided from respective reservoirs (not shown) and it is preferred that the composition of the ink droplets 26, 27 be substantially the same as the composition of the respective ink in the respective reservoir. A writehead preferably produces a negligible segregation of components of the ink, i.e., certain components are not intentionally preferentially retained by the writehead and certain other components are not intentionally preferentially jetted in the droplets 26, 27. More specifically, it is preferred that no applied fields are used in the writehead, e.g., such as when using a colloidal particulate ink so as to respectively increase the number of particles per unit volume in the respective jetted droplets 26 or 27 to a value higher than the respective number of particles per unit volume within the respective reservoir.

Inks for use in ink jet device 21 include marking and non-marking nonaqueous inks. Preferred marking and non-marking inks are dispersions, preferably colloidal dispersions, of particles in an insulating carrier liquid. The particles of a nonaqueous marking ink include any suitable colorant. Preferably, the particles of a marking ink are pigmented particles, and more preferably, solid pigmented particles; and preferably the particles of a non-marking ink are unpigmented particles, and more preferably, solid unpigmented particles. However, particles which are not colored may be used in a marking ink, including solid or liquid particles containing precursor chemicals that may be subsequently transformed, by any suitable chemical or physical process, into a material image having any useful property, composition or color, e.g., transformed when an ink-jet-ink-derived image is located either on intermediate member 28 or on a receiver, e.g., receiver 29*b*. A volume percentage of dispersed particulates in a nonaqueous colloidal ink useful in the invention may have any suitable value, typically between about 3% and 50%. Formulations similar to, or identical with, commercially available (nonaqueous) electrophotographic liquid developers may be used as inks for practicing the invention. Nonaqueous inks useful for the invention may be sterically stabilized dispersions, or may include both steric and electrostatic stabilization. Preferably, the dispersed particles carry an electrostatic charge, and polymeric counterions in the surrounding carrier fluid provide overall electrical neutrality. The particle sizes or particle size distributions of the particles used are similar to the particle sizes or particle size distributions of the particles used in commercial electrophotographic liquid developers. Particulate marking and non-marking nonaqueous ink dispersions useful for practice of the invention may be made by any known method, including grinding methods, precipitation methods, spray drying methods, limited coalescence methods, and so forth. Particulate marking and non-marking ink dispersions useful for practice of the invention may be formulated in any known way, such as by including dispersal agents, stabilizing agents, drying agents, glossing agents, and so forth. Pigmented particles used in marking ink dispersions of the invention may include one or more pigments, plus suitable binders for the pigments. Unpigmented particles used in non-marking ink dispersions are made primarily of binder material, which binder material is preferably similar to or identical with the binder used for marking particles, and which binder is preferably substantially colorless. Thus, in a final image transferred to a receiver in Transfer Process Zone 24, which final image contains both pigmented marking particles and unpigmented non-marking particles, it is preferable that an optical density of such a final image is proportional to the volume fraction of pigmented marking particles in the final image. A binder for either pigmented or unpigmented particles is typically made of one or more synthetic polymeric materials, which polymeric materials are selected to have good fusing properties for fusing a particulate image to a receiver for creating an output print, as described more fully below. Pigments used for marking ink dispersions are preferably commercially available pigments and may be crystalline or amorphous. Typically, a pigment is comminuted to very small sizes, e.g., sub-nanometer sizes, and dispersed substantially uniformly in a binder by known methods. It is preferred that pigments and binders used to make ink dispersions for the invention are substantially insoluble in the carrier liquids used for the dispersions. An alternative, non-marking, nonaqueous ink, for use in ink jet ink device 21, contains no unpigmented particles and consists primarily of a nonaqueous liquid, which liquid is preferably similar or identical to a carrier liquid used to formulate a pigmented particulate marking ink dispersion or an unpigmented particulate non-marking ink dispersion. Such a non-marking ink, when admixing with any marking ink dispersion to form a primary image on the operational surface of intermediate member 28, acts simply as a completely miscible diluent, and produces substantially no contribution to an optical density of a final image on a receiver. Particularly useful are mixtures of alkanes marketed by Exxon under the tradename Isopar, and various Isopars are available. Preferred Isopars are those having a flash point of 140° F. and above, such as Isopar L and Isopar M. However, other, lower molecular weight Isopars, such as Isopar G, may be used. It is also preferred to employ a concentrated precursor dispersion for both a marking ink dispersion and for a non-marking ink dispersion as used in ink jet device 21. A precursor dispersion may be manufactured as a concentrate having a high volume percentage of particulates, which concentrate is diluted with a respective carrier fluid to form a resulting respective ink prior to introducing the respective ink into the respective reservoir of the ink jet device 21.

Alternative inks for use in ink jet device 21 include marking and non-marking electrocoagulable inks, which are preferably aqueous-based inks. Any suitable electrocoagulable ink may be used in the practice of the subject invention. For example, an electrocoagulable ink for use in the invention includes any electrolytic ally coagulable colloid, which colloid may include a colorant or a finely divided pigment for use in a marking ink. Colloidal electrocoagulable inks having water as the dispersion medium are described, for example, in the Castegnier et al. patent (U.S. Pat. No. 5,928,417). An embodiment of an aqueous-based non-marking ink, for use in the invention with an aqueous-based electrocoagulable marking ink, may include no electrocoagulable component, i.e., which non-marking ink acts simply as a diluent when used to form a primary image with the aqueous-based electrocoagulable marking ink. Nevertheless, any such diluted portion of a primary image is required to be electrocoagulable. Preferably, an optical density of any electrocoagulate produced by electrocoagulation of any portion of such a diluted primary image is proportional to the volume fraction of the marking component in such an electrocoagulate.

A preferred embodiment of a non-marking ink for use with an aqueous-based electrocoagulable marking ink is an aqueous-based electrocoagulable ink, which electrocoagulable ink includes an electrocoagulable colloid that does not include any added colorant or pigment, which electrocoagulable colloid is preferably colorless before and after electrocoagulation. Such an electrocoagulable non-marking ink is preferably an aqueous-based colloidal dispersion very similar in nature to the preferred aqueous-based dispersion of the marking electrocoagulable ink, i.e., which electrocoagulable non-marking dispersion preferably includes similar materials, such as for example similar polymeric materials, similar stabilizers, similar dispersants, and so forth, such as used for formulating the marking electrocoagulable ink. Any admixture of such a preferred non-marking electrocoagulable ink with an electrocoagulable marking ink results in an electrocoagulable ink which, upon electrocoagulation, forms co-electrocoagulates from the combined marking and non-marking electrocoagulable components. Preferably, an optical density of any co-electrocoagulate produced by electrocoagulation of the combined marking and non-marking components is proportional to the volume fraction of the marking component in such a co-electrocoagulate.

In the Excess Liquid Removal Process Zone 13, excess liquid is removed from the coagulates formed in the Coagulate Formation Process Zone 12. In general, a portion, preferably a major portion, of the liquid is removed from the coagulates so as to form a liquid-depleted image, which liquid-depleted image can in certain cases retain a significant amount of residual liquid. In certain circumstances substantially all of the liquid may be removed to form the liquid-depleted image. Excess Liquid Removal Process Zone 23 includes an excess liquid removal device, which is any of the following known devices: a squeegee (roller or blade), an external blotter device, an evaporation device, a vacuum device, a skiving device, and an air knife device. These excess liquid removal devices are described more fully in related copending U.S. patent application Ser. No. 09/973,239, now U.S. Pat. No. 6,719,423 entitled Ink Jet Process Including Removal Of Excess Liquid From An Intermediate Member by Arun Chowdry, et al., and related copending U.S. patent application Ser. No. 09/973,244 now U.S. Pat. No. 6,682,189, entitled Ink Jet Imaging Via Coagulation On An Intermediate Member by John W. May, et al. Any other suitable excess liquid removal device or process may be used.

Transfer Process Zone 24 for transferring an ink-jet-ink-derived material image from intermediate member (IM) 28 to a receiver member includes any known transfer device, e.g., an electrostatic transfer device, a thermal transfer device, and a pressure transfer device, such as described fully in related copending U.S. patent application Ser. No. 09/973,239, U.S. Pat. No. 6,719,423 entitled Ink Jet Process Including Removal Of Excess Liquid From An Intermediate Member by Arun Chowdry, et al., and related copending U.S. patent application Ser. No. 09/973,244, now U.S. Pat. No. 6,682,189 entitled Ink Jet Imaging Via Coagulation On An Intermediate Member by John W. May, et al. As is well known, both an electrostatic transfer device and a thermal transfer device can be used with an externally applied pressure. An electrostatic transfer device for use in Transfer Process Zone 24 typically includes a backup roller (not shown), which backup roller is electrically biased by a power supply (not shown). The backup roller co-rotates in a pressure nip relationship with IM 28, and a receiver member such as sheet 29*a* is translated through the nip formed between the backup roller and IM 28. An ink-jet-ink-derived material image carrying an electrostatic net charge is transferable by an electrostatic transfer device from IM 28 to the receiver, i.e., an electric field is provided between IM 28 and the backup roller to urge transfer of the ink-jet-ink-derived material image. For use to augment electrostatic transfer when an ink-jet-ink-derived material image on IM 28 has a low electrostatic charge or is uncharged, a charging device (not shown) such as for example a corona charger or a roller charger or any other suitable charging device may be located between Excess Liquid Removal Process Zone 23 and Transfer Process Zone 24, which charging device may be used to suitably charge the ink-jet-ink-derived liquid-depleted material image prior to subsequent electrostatic transfer of the material image in Transfer Process Zone 24. Alternatively, a thermal transfer device may be used to transfer the ink-jet-ink-derived material image, which thermal transfer device can include a heated backup roller (not shown), which backup roller is heated by an external heat source such as a source of radiant heat or by a heated roller (not shown) contacting the backup roller (not shown). Alternatively, the backup roller for thermal transfer can be heated by an internal source of heat. The backup roller for thermal transfer co-rotates in a pressure nip relationship with IM 28, and a receiver member such as sheet 29*a* is translated through the nip formed between the heated backup roller and IM 28. In certain embodiments, IM 28 may be similarly heated, either from an internal or external source of heat. As an alternative, a thermal Transfer Process Zone 24 may include a transfusing device, wherein an ink-jet-ink-derived material image is thermally transferred to and simultaneously fused to a receiver. As yet another alternative, a pressure transfer device may be used in Transfer Process Zone 24 to transfer an ink-jet-ink-derived material image, which pressure transfer device includes a backup pressure roller (not shown) which pressure roller co-rotates in a pressure nip relationship with IM 28, and a receiver member such as sheet 19*a* is translated through the nip formed between the pressure backup roller and IM 28. In such a pressure transfer device, an adhesion of the ink-jet-ink-derived material image is preferably much greater on the surface of the receiver than on the operational surface of IM 16, and preferably the adhesion to the operational surface of IM 16 is negligible.

As an alternative to the use of receiver sheets such as sheets 19*a*, 19*b* in the Transfer Process Zone 24 of any of the above-described embodiments, a receiver in the form of a continuous web (not illustrated) may be used in Transfer Process Zone 24, which web passes through a pressure nip formed between roller 28 and a transfer backup roller (not illustrated). A receiver in the form of a continuous web may be made of paper or any other suitable material.

In other alternative embodiments, a transport web (not illustrated) to which receiver sheets are adhered may be used in Transfer Process Zone 24 to transport receiver sheets through a pressure nip formed between roller 28 and a transfer backup roller (not illustrated).

A receiver, for example receiver 19*b*, which has passed through Transfer Process Zone 24 may be moved in the direction of arrow B to a fusing station (not shown in FIG. 2).

Apparatus 20 may be included as a color module in a full color ink jet imaging machine. A receiver such as receiver 19*b*, which has received an ink-jet-ink-derived material image of a particular color from IM 28, may be transported through another module entirely similar to apparatus 20, wherein an ink-jet-ink-derived material image of a different color may be transferred from a similar intermediate member in a similar Transfer Process Zone, which different color image is transferred atop and in registration with the ink-jet-ink-derived material image transferred to the receiver in apparatus 20. In a set of such similar modules arranged in tandem, ink-jet-ink-derived material images forming a complete color set may be successively transferred in registry one atop the other, thereby creating a full color material image on a receiver. The resulting full color material image may then be transported to a fusing station wherein the material image is fused to the receiver. In one embodiment of such a full color ink jet imaging machine, the receiver member is adhered to a transport web for carrying the receiver through the respective color modules and thence to the fusing station. In another embodiment (not illustrated) of such a full color ink jet imaging machine, the receiver member is adhered to a rotatable member, such as for example a large drum, which receiver member is rotated past each of the respective modules wherein in each module a different color liquid-depleted ink-jet-ink-derived material image is transferred in register atop any previously transferred liquid-depleted ink-jet-ink-derived material image(s). An alternative embodiment (not illustrated) of a full color ink jet imaging machine includes a plurality of modules, each of which respectively includes an ink jet ink device similar to device 21, a Coagulate Formation Process Zone similar to zone 22, an Excess Liquid Removal Process Zone similar to zone 23, and a Regeneration Process Zone similar to zone 25, wherein a different color liquid-depleted ink-jet-ink-derived material image is transferred in a respective transfer process zone to a common rotatable member, such as for example a large drum. In this alternative embodiment of a full color ink jet imaging machine, each different color liquid-depleted ink-jet-ink-derived material image is respectively transferred to the common rotatable member in register atop any previously transferred liquid-depleted ink-jet-ink-derived material image(s) thereon so as to build up a fill color image on the common rotatable member, whereupon the full color image is subsequently transferred in a full color image transfer station from the common rotatable member to a receiver member.

The operational surface of intermediate member 28, after leaving the Transfer Process Zone 24, is rotated to a Regeneration Process Zone 25 where the operational surface is prepared for a new primary image to be subsequently formed by ink jet device 21. In one embodiment, the Regeneration Process Zone is a cleaning process zone wherein residual material of the liquid-depleted material image is substantially removed using known devices or methods, including use of a cleaning blade (not shown) or a squeegee (not shown) to scrape the operational surface substantially clean. Alternatively, a cleaning roller (not shown) or web (not shown) is provided to which residual material of the liquid-depleted material image adheres, thereby producing a substantially clean operational surface in Regeneration Process Zone 25. As another alternative, an external vacuum device (not shown) may be used in Regeneration Process Zone 25 to suck up and possibly recycle any residual liquid from the operational surface of member 28. Any other known suitable cleaning mechanisms, including brushes, wipers, solvent applicators, and so forth (not shown), may be used to form a regenerated surface.

Figure 3B:
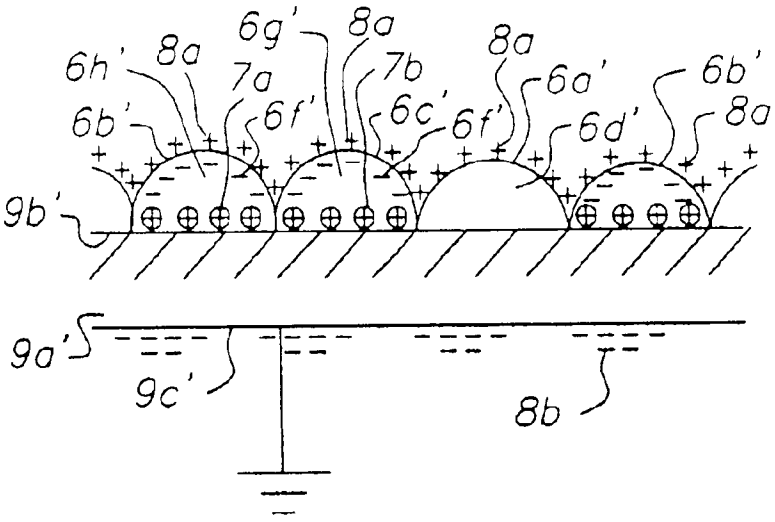
FIGS. 3*a,b* schematically depicts a formation, by use of a corona charging device, of an embodiment of a two-fluid ink jet ink concentrated image, in which embodiment the concentrated image is made from an ink jet ink containing pigmented charged particles.
Figure 3A:
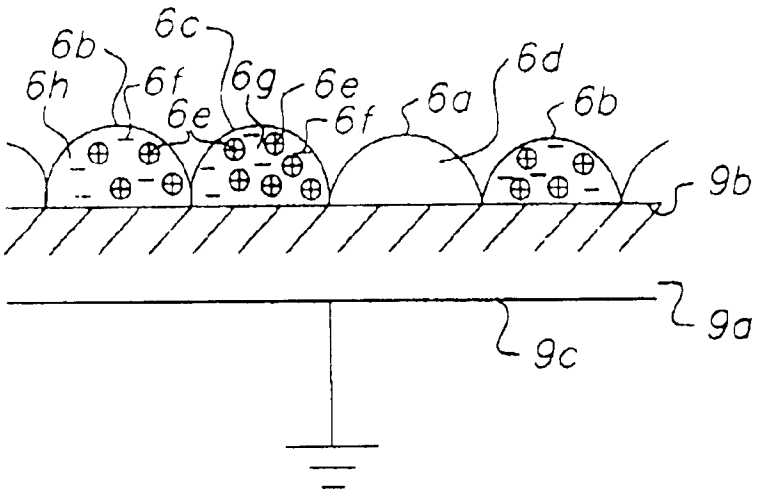

FIG. 3*a,b* illustrates the effect of using a corona charging device as a preferred electric field mechanism for forming coagulates in a primary image of a nonaqueous dispersion of charged particles. In schematic side view in FIG. 3*a, a* two-fluid primary image is shown corresponding to FIG. 1*d*, and this primary image includes several imaging pixels containing drops formed by an intermixing of droplets of a nonaqueous marking ink and droplets of a nonaqueous non-marking ink co-deposited on an operational surface 9*b* of an intermediate member, e.g., a roller or a web, by ink jet device 21, which ink jet device as described above includes a first source of a first ink and a second source of a second ink. All of the drops of the primary image of FIG. 3 a are preferably of substantially equal volume, containing complementary amounts of the first and second inks, as previously described above. The intermediate member (not separately identified) includes a layered structure 9*a* having one or more layers and a grounded electrode 9*c* shown located below the layered structure 9*a*. The marking ink which is used to form the primary image is a dispersion of charged pigmented particles 6*e* dispersed in a carrier liquid 6*g*, i.e., the drop labeled 6*c* represents Dmax. Drop 6*c* (strong hatching) contains no non-marking ink, and therefore has the maximum number of particles per unit volume in an imaging pixel of the primary image. The non-marking ink contains no added particles and is miscible with the carrier fluid 6*g*. Drop 6*a* (no hatching) representing Dmin, is made entirely of the non-marking ink, 6*d*, and therefore contains no added particles. Each drop labeled 6*b* (medium hatching) includes a mixture of the marking and non-marking inks, so that the liquid 6*h* is a mixture of the liquids 6*d* and 6*g*. The charged particles 6*e* may have positive or negative polarity (here shown as positive) and their charges are balanced by oppositely charged counterions or micelles 6*f* in the liquid of each drop mixture. Layered structure 9*a* is preferred to be electrically insulating and is adhered to electrode 9*c*, which electrode may be the surface of a metallic drum, e.g., made of aluminum or other suitable metal, on which layer 9*a* is formed or coated. As an alternative, electrode 9*c* can be a thin conductive layer, e.g., made of nickel or other suitable metal, which electrode is coated on or adhered to a support (not shown) made of any suitable material, e.g., a polymeric material. The support may be included in a web, or may surround a metallic drum so as to form an intermediate member roller, e.g., intermediate roller 28. Alternatively, layered structure 9*a* may be semiconductive. FIG. 3*b*, in which primed (') entities correspond to unprimed entities in FIG. 3*a*, illustrates the result of corona charging of the primary image of FIG. 3*a* by a corona charging device (not shown). The polarity of the corona ions deposited on the primary image is the same as that of particles 6*e*(here positive) so that for example positive corona ions 8*a* are shown at the outer surface of drop 6*c*' in non-injecting contact with the carrier liquid 6*g*'. Other non-injecting corona ions 8*a* are shown deposited by the corona charging device on the surfaces of drops 6*a*' and 6*b*'. Induced counter charges 8*b* on electrode 9*c*' provide electric fields in layered structure 9*a*' and within the drops of the primary image. As a result of the fields within the drops, particles 6*e* are shown as having migrated towards the operational surface 9*b*' where they preferably form compact layers, e.g., layers 7*a*, 7*b* of coagulates held down by the electrostatic attraction from the corresponding counter-charges 8*b* as well as by dispersion or van der Waals type attractive forces. The counterions or micelles 6*f* are shown migrated to the outer surfaces of drops 6*b*', 6*c*', thereby partially compensating or neutralizing the corona charges 8*a*. The corona charging device includes any known corona charging device, e.g., an AC or a DC charger, and may further include one or both of a plurality of corona wires and a grid. As previously described above, after formation of coagulate layers such as 7*a*, 7*b* by the charging action of the corona charging device, any excess liquid is removed from the image on the intermediate member by any suitable means in the Excess Liquid Removal Process Zone 23 of FIG. 2, and the liquid-depleted layers 7*a*, 7*b* transferred by any suitable means from the intermediate member to a receiver in the Transfer Process Zone 24.

In the above preferred electric field mechanism using a corona charging device for causing coagulation, it is preferable to use a non-marking ink which is a dispersion of unpigmented particles, rather than a non-marking ink containing no particles as described in reference to FIG. 3*a,b*. Thus, every pixel of a two-fluid primary image contains a mixture of an amount of a dispersion of marking pigmented particles dispersed in a first carrier liquid, and a complementary amount of a preferred dispersion of non-marking unpigmented particles dispersed in a second carrier liquid, e.g., as described above with reference to FIG. 1*e*, such that both dispersions are co-deposited on the operational surface of the intermediate member as the first and second inks by the ink jet device 21. Thus, by analogy and with further reference to FIG. 3*a*, each pixel of the primary image contains a complementary number of non-marking unpigmented particles, in addition to the marking pigmented particles (not separately illustrated). The non-marking unpigmented particles of the preferred non-marking ink are preferably similarly charged and have the same polarity as the marking pigmented particles, and the corresponding counterions associated with the non-marking unpigmented particles are preferably similar in nature to the counterions associated with the marking pigmented particles, and more preferably, identical in nature to the counterions associated with the marking pigmented particles. Preferably, the first and second carrier liquids are similar to one another, and more preferably, the first and second carrier liquids are identical. In a primary image using this preferred non-marking ink, a Dmax pixel, e.g., a pixel corresponding to drop 6*c* in FIG. 3*a*, contains no amount of the dispersion of non-marking unpigmented particles. Similarly, a Dmin pixel, e.g., corresponding to drop 6*a* in FIG. 3*a*, contains no amount of the dispersion of marking pigmented particles, and an intermediate density pixel, corresponding to drops 6*b*, contains an admixture of the two dispersions. In each of the pixels included in the primary image, the volume of liquid per pixel is preferably substantially the same. By analogy and with reference to FIG. 3*b*, the charging action of the corona charging device produces a Dmax pigmented-particle coagulate, entirely corresponding to layer 7*b* and containing no added unpigmented particles. On the other hand, a preferably colorless unpigmented-particle coagulate layer will be formed by the corona charging device in a Dmin pixel (no such corresponding layer is formed in drop 6*a*'). A mixed particle coagulate layer, containing both pigmented and unpigmented particles, will be formed in an intermediate density pixel (i.e., corresponding to drops 6*b*' in which only pigmented particles form the coagulate layer 7*a*). It is preferred that any thickness of any coagulate layer, formed on the operational surface of the intermediate member and including marking particles, non-marking particles or both marking and non-marking particles, is substantially the same. As previously described above, after formation of such coagulate layers by the charging action of the corona charging device, any excess liquid is removed from the image on the intermediate member by any suitable means in the Excess Liquid Removal Process Zone 23 of FIG. 2, and the liquid-depleted layers transferred by any suitable means from the intermediate member to a receiver in the Transfer Process Zone 24. It will be especially noted that, for the preferred situation wherein any thickness of a coagulate layer containing any proportion of pigmented and unpigmented particles is substantially the same, the resulting efficiency of transfer to a receiver will generally be much more uniform than for the varyingly thick coagulate layers such as layers 7*a*, 7*b* formed as in FIG. 3*b*. Moreover, it will be evident that after transfer to the receiver of any ink-jet-ink-derived material image formed by utilizing this preferred non-marking ink dispersion, the resulting unfused image quality will be superior as compared to utilizing a non-marking ink containing no particles. The improved image quality results from the more uniform transfer of the resulting liquid-depleted image, including a more efficient transfer of the material in the lower density pixels. Following any subsequent fusing of the resulting ink-jet-ink-derived material image to the receiver, the resulting image quality will be superior as compared to that obtained by using a non-marking ink containing no particles, i.e., the gloss will be much more uniform. Also, a perceived image mottle, such as caused by a nonuniform thickness of the ink-jet-ink-derived material image produced by using a non-marking ink containing no particles, will be much reduced. It should be noted that the physical properties of the non-marking particles of the preferred non-marking ink can be advantageously tailored, e.g., for improved fusing and improved gloss of an ink-jet-ink-derived material image on a receiver. Moreover, in conjunction with use of a corona charging device in the Coagulate Formation Process Zone 22, it can be advantageous to deliver from the ink jet device 21 to each pixel of a primary image an extra number of droplets of the non-marking unpigmented particulate ink, for further improvements of fusing and image gloss properties after subsequent transfer of the corresponding liquid-depleted image to the receiver.

Figures 4A, 4B, 4C:
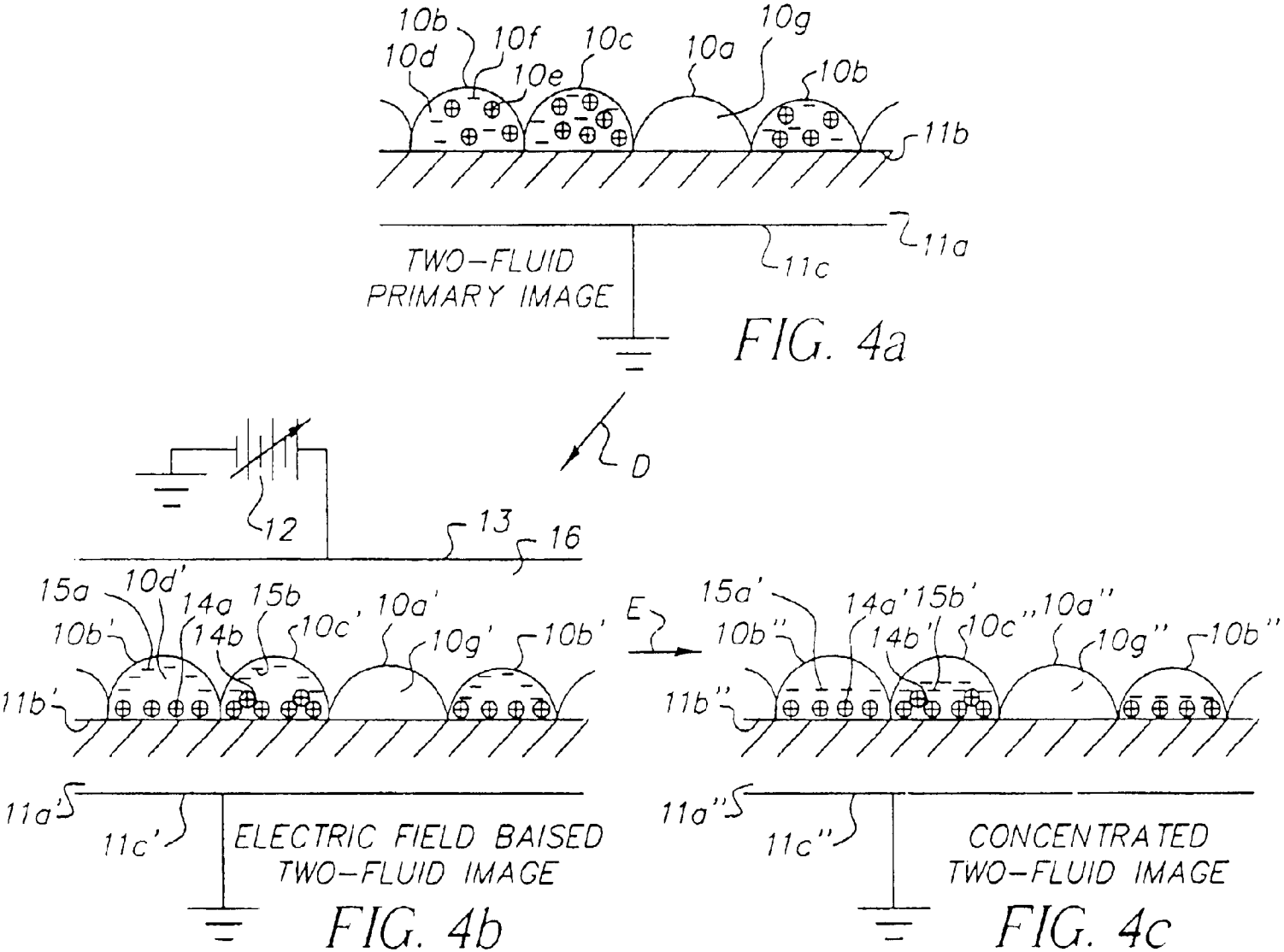
FIGS. 4*a,b,c* schematically depicts a formation, by use of a non-contacting electrode device, of a two-fluid primary ink jet ink concentrated image, in which embodiment the concentrated image is made from an ink jet ink containing pigmented charged particles.

FIGS. 4*a,b,c* illustrates schematically the effect of using an external non-contacting electrode device as another embodiment of an electric field mechanism for forming coagulates in a primary image of a nonaqueous dispersion of charged particles. In schematic side view in FIG. 4*a, a* two-fluid primary image is shown corresponding to FIGS. 1*d* and 3*a*. The primary image similarly includes imaging pixels containing drops lob formed by an intermixing of droplets of a nonaqueous marking pigmented ink dispersion and droplets of a nonaqueous non-marking ink, both inks similar to those described with reference to FIG. 3*a* and co-deposited on an operational surface 11*b* of an intermediate member, e.g., a roller or a web, by ink jet device 21. The intermediate member (not separately identified) similarly includes a similar layered structure 11*a*, and a similar grounded electrode 11*c*. All of the drops 10*a,b,c* of the primary image of FIG. 4*a* are preferably of substantially equal volume, containing complementary amounts of the two inks, as previously described above, with drop 10*g* similar to 10*a* containing only non-marking ink (no hatching), drop 10*b* containing a mixture of marking ink and non-marking ink (medium hatching), and drop 10*c* containing only marking ink (strong hatching). Each drop such as 10*b* includes charged particles 10*e* which particles may have positive or negative polarity (here shown as positive) and their charges are balanced by oppositely charged counterions or micelles 10*f* in the mixed nonaqueous carrier liquid 10*d*, which counterions or micelles originated in the marking ink. As indicated by arrow D, the primary image of FIG. 4*a* is moved beneath a biased non-contacting electrode 13 connected to a variable voltage supply 12, which electrode is in close proximity to drops 10*a',b',c*'. In FIG. 4*b*, single primed (') elements correspond to the unprimed elements of FIG. 4*a*. The electrode 13 is biased to the same polarity as that of particles 10*e* (here positive). Thus, a positive polarity on electrode 13 produces an electric field between electrode 13 and electrode 11*c*' so as to cause a polarization of drops 10*b',c*' which polarization is produced by migration of the positive marking particles to the operational surface 11*b*' so as to form respective layers 14*a,b* of coagulated particles, and by corresponding migration of the respective counterions (here negative) to give surface charges 15*a,b*. The electrode 13 may be covered with a protective layer (not shown), which protective layer has a surface facing the primary image yet not in contact with any portion of the primary image. The layers 14*a,b* include pigmented particles all of which are in direct contact with one another or with surface 11*b*'. FIG. 4*c* shows the situation after moving the image on the intermediate member away from the influence of electrode 13, as indicated by arrow E. In FIG. 4*c*, a concentrated two-fluid primary image is shown in which the double primed (") elements correspond to the single primed elements of FIG. 4*b*. The surface charges 14*a,b* of FIG. 4*b* have been attracted downwards towards the opposite charges in the coagulate layers, so as to form layers in which the charged particles 14*a',b*' are compensated or neutralized by the corresponding countercharges 15*a',b*'. By virtue of dispersion or van der Waals type attractive forces, particles 14*a',b*' are adhered to operational surface 11*b*". To enhance the strength of the dispersion or van der Waals type attractive forces between ink particles and the intermediate member 11*a*', the intermediate member preferably has a high dielectric constant. For example, a polyurethane having a dielectric constant of about 6 is particularly useful for inclusion in the intermediate member, as compared with many common polymers having a dielectric constant close to 3. Fluoropolymers are also useful in this regard. Suitable particulate fillers may be provided in the intermediate member 11*a*" to increase the dielectric constant. Owing to the electroneutrality of all the drops 10*a*",*b*",*c*" any excess liquid located above the particles 14*a*',*b*' is readily removed by any suitable means, e.g., in Excess Liquid Removal Process Zone 23, as described earlier above.

In the above preferred electric field device including a non-contacting electrode device for causing coagulation, it is preferable to use a non-marking ink which is a dispersion of unpigmented particles, rather than a non-marking ink containing no particles as described in reference to FIGS. 4*a,b,c*. Thus, every pixel of a two-fluid primary image contains a mixture of an amount of a dispersion of marking pigmented particles dispersed in a first carrier liquid, and a complementary amount of a preferred dispersion of non-marking unpigmented particles dispersed in a second carrier liquid, e.g., as described above with reference to FIG. 1*e*, such that both dispersions are co-deposited on the operational surface of the intermediate member as the first and second inks by the ink jet device 21. Thus, by analogy and with further reference to FIG. 4*a*, each pixel of the primary image contains a complementary number of non-marking unpigmented particles, in addition to the marking pigmented particles (not separately illustrated). The non-marking unpigmented particles of the preferred non-marking ink are preferably similarly charged and have the same polarity as the marking pigmented particles, and the corresponding counterions associated with the non-marking unpigmented particles are preferably similar in nature to the counterions associated with the marking pigmented particles, and more preferably, identical in nature to the counterions associated with the marking pigmented particles. Preferably, the first and second carrier liquids are similar to one another, and more preferably, the first and second carrier liquids are identical. In a primary image using this preferred non-marking ink, a Dmax pixel, e.g., a pixel corresponding to drop 11*c* in FIG. 4*a*, contains no amount of the dispersion of non-marking unpigmented particles. Similarly, a Dmin pixel, e.g., corresponding to drop 11*a* in FIG. 4*a*, contains no amount of the dispersion of marking pigmented particles, and an intermediate density pixel, corresponding to drops 10*b*, contains an admixture of the two dispersions. In each of the pixels included in the primary image, the volume of liquid per pixel is preferably substantially the same. By analogy and with reference to FIG. 4*b*, the electric field action of the non-contacting electrode device produces a Dmax pigmented-particle coagulate, entirely corresponding to layer 14*b* and containing no added unpigmented particles. On the other hand, a preferably colorless unpigmented-particle coagulate layer will be formed by the non-contacting electrode device in a Dmin pixel (no such corresponding layer is formed in drop 10*a*'). A mixed particle coagulate layer, containing both pigmented and unpigmented particles, will be formed in an intermediate density pixel (i.e., corresponding to drops 10*b*' in which only pigmented particles form the coagulate layer 14*a*). In a two-fluid concentrated image on the operational surface of the intermediate member, it is preferred that any thickness of any coagulate layer, which coagulate layer includes marking particles, non-marking particles or both marking and non-marking particles, is substantially the same. As previously described above, after formation of such coagulate layers by the electric field action of the non-contacting electrode device, any excess liquid is removed from the image on the intermediate member by any suitable means, e.g., in the Excess Liquid Removal Process Zone 23 of FIG. 2, and the liquid-depleted layers transferred by any suitable means from the intermediate member to a receiver in the Transfer Process Zone 24. It will be especially noted that, for the preferred situation wherein any thickness of a coagulate layer containing any proportion of pigmented and unpigmented particles is substantially the same, the resulting efficiency of transfer to a receiver will generally be much more uniform than for the varyingly thick coagulate layers such as layers 14*a*, 14*b* formed as in FIG. 4*b*. Moreover, it will be evident that after transfer to the receiver of any ink-jet-ink-derived material image formed by utilizing this preferred non-marking ink dispersion, the resulting unfused image quality will be superior as compared to utilizing a non-marking ink containing no particles. The improved image quality results from the more uniform transfer of the resulting liquid-depleted image, including a more efficient transfer of the material in the lower density pixels. Following any subsequent fusing of the resulting ink-jet-ink-derived material image to the receiver, the resulting image quality will be superior as compared to that obtained by using a non-marking ink containing no particles, i.e., the gloss will be much more uniform. Also, a perceived image mottle, such as caused by a nonuniform thickness of the ink-jet-ink-derived material image produced by using the previous embodiment, will be much reduced. It should be noted that the physical properties of the non-marking particles of the preferred non-marking ink can be advantageously tailored, e.g., for improved fusing and improved gloss of an ink-jet-ink-derived material image on a receiver. Moreover, in conjunction with use of a non-contacting electrode device in the Coagulate Formation Process Zone 22, it can be advantageous to deliver from the ink jet device 21 to each pixel of a primary image an extra number of droplets of the non-marking unpigmented particulate ink, for further improvements of fusing and image gloss properties after subsequent transfer of the corresponding liquid-depleted image to the receiver.

Figure 5A:
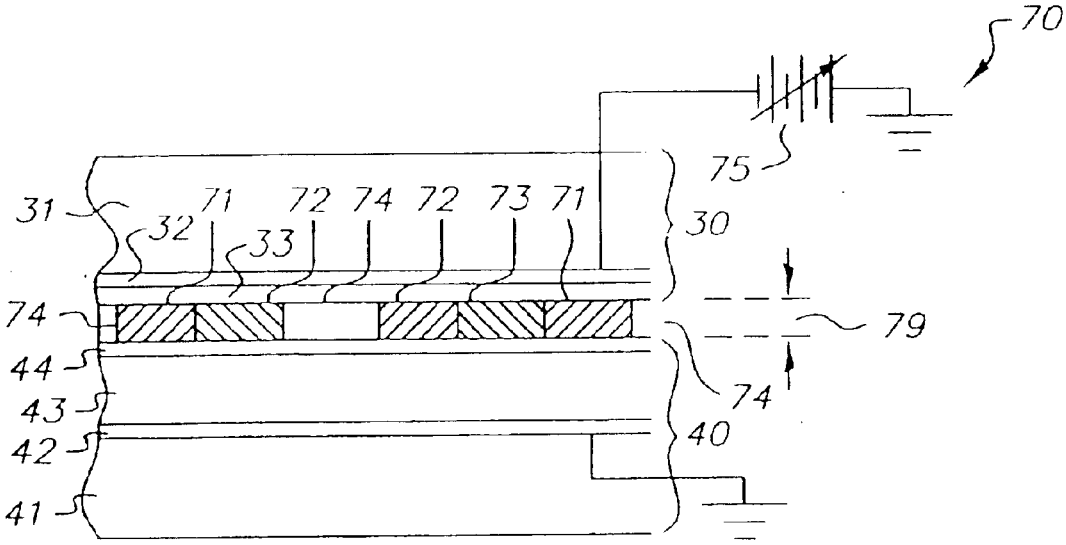
FIG. 5*a* schematically illustrates a side elevational view of an electrode device and a side elevational view of an intermediate member, which contacting electrode device and which intermediate member are separated by a gap, which gap is filled by an intermixed two-fluid primary ink jet ink image corresponding to FIG. 1*d;*

FIG. 5*a* schematically illustrates, in an elevational side view, as indicated by the numeral 70, a use of yet another electric field mechanism for forming coagulates in a primary image of a nonaqueous dispersion of charged particles. A portion of a contacting electrode device 30 is shown in proximity to an intermediate member 40 and separated therefrom by a uniform gap 79 (contacting electrode device not fully illustrated). Within the gap 79, and preferably just filling this gap, is a primary image (corresponding to the primary images shown in FIGS. 1*c,d*) which primary image was priorly formed on the intermediate member 40 which has been moved beneath the contacting electrode device 30. The contacting electrode device is preferably a rotatable member, e.g., a roller or a web, which rotatable member is held by a positioning device to define the gap 79, which positioning device preferably includes a controller for producing a constant force or pressure against the liquid within the gap. Alternatively, and preferably, a rotatable contacting electrode device having the form of a roller may be mechanically "floated" on the liquid in the gap, in manner as is done in a conventional off-set printing press. A preferred width of gap 79 lies in a range of approximately between 5 micrometers and 100 micrometers, although any suitable gap width may be used. Generally speaking, the higher the image resolution (dpi) the smaller the gap. As indicated for the primary image of FIG. 1*d*, the primary image corresponding to FIG. 5*a* is made by an intermixing of droplets of a nonaqueous marking ink and droplets of a nonaqueous non-marking ink co-deposited so as to form the primary image by ink jet device 21. The marking ink which is used to form the primary image is a dispersion of charged pigmented particles dispersed in a carrier liquid. The non-marking ink contains no marking particles and is miscible with the carrier fluid of the marking ink. All of the pixels of the primary image of FIG. 5*a* preferably have substantially equal volumes, with each pixel containing complementary amounts of the marking and non-marking inks, as previously described above. Thus, the liquid of pixels labeled 74 contain only non-marking ink (corresponding to Dmin) and the pixels labeled 71 contain only marking ink (corresponding to Dmax). The pixels labeled 72 and 73 contain mixtures of the marking and non-marking inks, with pixels 72 containing more marking ink than pixel 73. Thus, increasing amounts of hatching indicate increasing proportions of marking ink per pixel.

The contacting electrode device 30 includes a power supply 75 for biasing with an applied voltage an electrode 32 located within the contacting electrode device in order to provide, with grounded electrode 42 located within the intermediate member 40, an electric field in the liquid contained within gap 79. The electric field is in a direction to urge any charged particles in the primary image to migrate towards the outer surface of the intermediate member 40. For clarity of exposition, the illustration of FIG. 5*a* is a hypothetical snapshot before this electric field has acted for any significant time; i.e., before significant migration of the charged particles included in the liquid of the primary image. Electrode 32 is preferably covered by a thin layer or layers 33, which layer is preferably insulating. Alternatively, layer 33 is semiconductive. The thickness of layer(s) 33 is not critical, but is preferred to be thinner than about 1 millimeter and more preferably thinner than about 10 micrometers. Preferably, layer 33 is wettable by the marking ink, the non-marking ink, or any mixture of the marking ink and the non-marking ink.

The intermediate member 40 includes a preferably compliant layer 43 formed on a support 41 and an optional thin outer layer 44 formed on layer 43. Preferably intermediate member 40 is a roller and support 41 is a metallic drum, e.g., made of aluminum or any other suitable metal, which drum is preferably grounded (grounding of layer 41 not shown in FIG. 5*a*) or connected to a suitable voltage from a source of potential such as a power supply (not shown). An optional thin conductive electrode layer 42 is shown sandwiched between layers 41 and 43 which layer is connected to ground (as shown) or to a power supply (not shown). In an alternative embodiment, intermediate member 40 is an endless web. In this alternative embodiment, a flexible conductive electrode layer 42 is provided sandwiched between layer 43 and a flexible support 41, which support may include polymeric materials including reinforced materials. In another alternative embodiment, support 41 is included in a linearly-movable platen, or adhered to a linearly-movable platen.

Layer 43 has a thickness preferably in a range of approximately between 0.5 mm and 10 mm, and more preferably, between 0.5 mm and 3 mm. In certain embodiments, layer 43 is electrically insulating. In preferred embodiments, layer 43 is semiconducting and has a resistivity preferably less than approximately $10^{10}$ ohm-cm and more preferably less than $10^{7}$ ohm-cm. Layer 43 is preferably made from a group of materials including polyurethanes, fluoroelastomers, and rubbers including fluororubbers and silicone rubbers, although any other suitable material may be used. For controlling resistivity, layer 43 may include a particulate filler or may be doped with compounds such as for example antistats. In other embodiments in which outer layer 44 is not included, the outer surface of layer 43 is preferred to have a suitable surface energy controlled within a suitable range by a thin coating (not shown) of any suitable surface active material or a surfactant.

Optional layer 44 has a thickness preferably in a range of approximately between 1 micrometer and 20 micrometers. Layer 44 is preferred to be both flexible and hard, and is preferably made from a group of materials including sol-gels, ceramers, and polyurethanes. Other materials, including fluorosilicones and fluororubbers, may alternatively be used. Layer 44 preferably has a high dielectric constant and suitable particulate fillers may be provided in layer 44 to increase the dielectric constant. An outer surface of layer 44 is preferred to have a suitable surface energy which may be controlled within a suitable range by a thin extra coating (not shown) of any suitable surface active material or a surfactant.

Figure 5B:
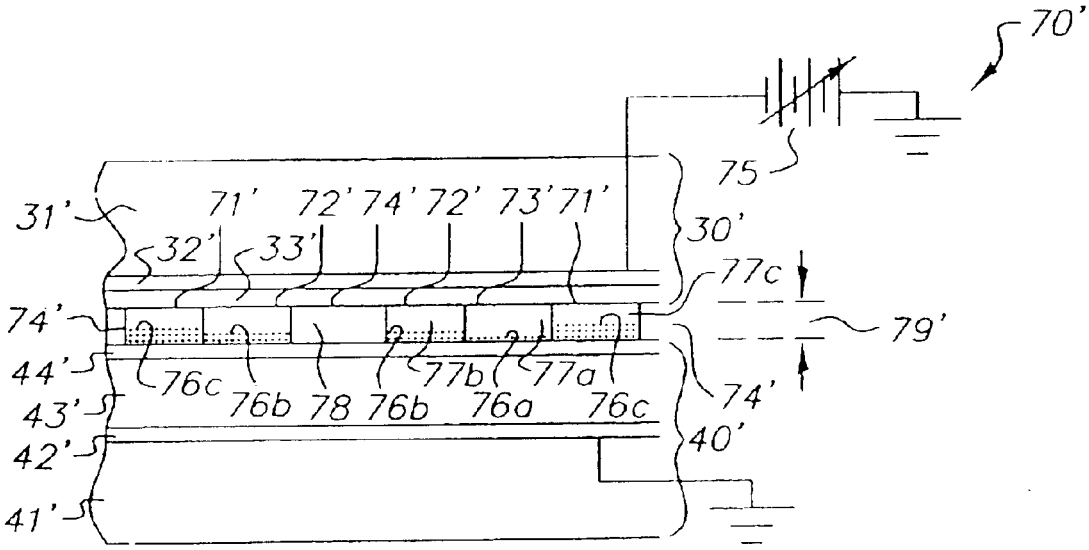
FIG. 5*b* schematically illustrates in more detail a concentrated image produced, on an operational surface of the intermediate member of FIG. 5*a*, by an action of an electric field applied in the gap of FIG. 5*a;*

FIG. 5*b*, in which single primed (') quantities refer to the unprimed similar quantities in FIG. 5*a*, shows the effect of the action of the electric field produced by power supply 75'. Marking particles in the pixels 71', 72' and 73' are shown migrated down to respectively form the respective concentrated coagulate layers 76*c*, 76*b* and 76*a* on the outer surface of layer 44'.

Above the respective layers 76*c*, 76*b* and 76*a* are respective liquids 77*c*, 77*b*, and 77*a*, which liquids are preferably completely exhausted of any marking particles. Any counterions respectively contained in the respective pixels are migrated to the outer surface of layer 73' (counterions not shown). The point in time shown in FIG. 5*b* represents the time before the rotating intermediate member 40 moves the image away from the contacting electrode device 30 towards the Excess Liquid Removal Process Zone 23, i.e., before breaking contact with the liquid in the gap 79'. After leaving the Coagulate Formation Process Zone 22, the electrostatic charges on the particles in the layers 76*c*, 76*b* and 76*a* induce countercharges in the electrode 42', causing mutual attractions between the electrostatic charges on the particles and the respective counterions, thereby holding the layers 76*c*, 76*b* and 76*a* adhered to the outer surface of the intermediate member 40. This electrostatic adhesion holds the layers 76*c*, 76*b* and 76*a* firmly in position during subsequent removal of excess liquid in the Excess Liquid removal process Zone 23.

In the above yet another preferred electric field mechanism using a contacting electrode device, it is preferable to use a non-marking ink which is a dispersion of unpigmented particles, rather than a non-marking ink containing no particles as described in reference to FIGS. 5*a,b*. Thus, every pixel of a two-fluid primary image contains a mixture of an amount of a dispersion of marking pigmented particles dispersed in a first carrier liquid, and a complementary amount of a preferred dispersion of non-marking unpigmented particles dispersed in a second carrier liquid, e.g., as described above with reference to FIG. 1*e*, such that both dispersions are co-deposited on the operational surface of the intermediate member as the first and second inks by the ink jet device 21. Thus, in this preferred usage of a contacting electrode mechanism, and by analogy and with further reference to FIG. 5*a*, each pixel of the primary image which is neither a Dmax pixel or a Dmin pixel contains a complementary number of non-marking unpigmented particles, in addition to the marking pigmented particles (not separately illustrated). The non-marking unpigmented particles of the preferred non-marking ink are preferably similarly charged and have the same polarity as the marking pigmented particles, and the corresponding counterions associated with the non-marking unpigmented particles are preferably similar in nature to the counterions associated with the marking pigmented particles, and more preferably, identical in nature to the counterions associated with the marking pigmented particles. Preferably, the first and second carrier liquids are similar to one another, and more preferably, the first and second carrier liquids are identical. In a primary image using this preferred non-marking ink, a Dmax pixel, e.g., corresponding to a pixel 71 in FIG. 5*a*, contains no amount of the dispersion of non-marking unpigmented particles. Similarly, a Dmin pixel, e.g., corresponding to a pixel 74 in FIG. 5*a*, contains no amount of the dispersion of marking pigmented particles, and an intermediate density pixel, corresponding to a pixel 72 or 73, contains an admixture of the two dispersions. In each of the pixels included in the primary image, the volume of liquid per pixel is preferably substantially the same. By analogy and with reference to FIG. 5*b*, the electric field action of the contacting electrode device produces a Dmax pigmented-particle coagulate, entirely corresponding to layer 76*c* and containing no added unpigmented particles. On the other hand, a preferably colorless unpigmented-particle coagulate layer will be formed by the contacting electrode device in a Dmin pixel, such as pixel 74'. A mixed particle co-coagulate layer, containing both pigmented and unpigmented particles, will be formed in an intermediate density pixel, such as pixel 72' or 73'. It is preferred that any thickness of any coagulate layer caused to be formed on the surface of intermediate member 40' by use of the electrode device 30', which coagulate layer includes marking particles, non-marking particles or both marking and non-marking particles, is substantially the same. As previously described above, after formation of such coagulate layers by the electric field action of the contacting electrode device, any excess liquid is removed from the image on the intermediate member by any suitable means, e.g., in Excess Liquid Removal Process Zone 23 of FIG. 2, and the liquid-depleted layers transferred by any suitable means from the intermediate member to a receiver in the Transfer Process Zone 24. Owing to the advantageous fact that the amounts of excess liquid per pixel are substantially the same for all pixels, it will be generally easier for these amounts of liquid to be efficiently removed, e.g., in an Excess Liquid Removal Process Zone 23, than would be the case for the nonuniform amounts of excess liquid 77*a,b,c* and 78 in FIG. 5*b*.

It will be especially noted that, for the preferred situation wherein any thickness of a coagulate layer containing any proportion of pigmented and unpigmented particles is substantially the same, the resulting efficiency of transfer to a receiver will generally be much more uniform than for the varyingly thick coagulate layers such as formed in pixels 71', 72', 73', and 74' of FIG. 5*b*. Moreover, it will be evident that after transfer to the receiver of any ink-jet-ink-derived material image formed by utilizing this preferred non-marking ink dispersion, the resulting unfused image quality will be superior as compared to utilizing a non-marking ink containing no particles. The improved image quality results from the more uniform transfer of the resulting liquid-depleted image, including a more efficient transfer of the material in the lower density pixels. Following any subsequent fusing of the resulting ink-jet-ink-derived material image to the receiver, the resulting image quality will be superior as compared to that obtained by using a non-marking ink containing no particles, i.e., the gloss will be much more uniform. Also, a perceived image mottle, such as caused by a nonuniform thickness of the ink-jet-ink-derived material image produced by using the previous embodiment, will be much reduced. It should be noted that the physical properties of the non-marking particles of the preferred non-marking ink can be advantageously tailored, e.g., for improved fusing and improved gloss of an ink-jet-ink-derived material image on a receiver. Moreover, in conjunction with use of a non-contacting electrode device in the Coagulate Formation Process Zone 22, it can be advantageous to deliver from the ink jet device 21 to each pixel of a primary image an extra number of droplets of the non-marking unpigmented particulate ink, for further improvements of fusing and image gloss properties after subsequent transfer of the corresponding liquid-depleted image to the receiver.

Figure 6A:
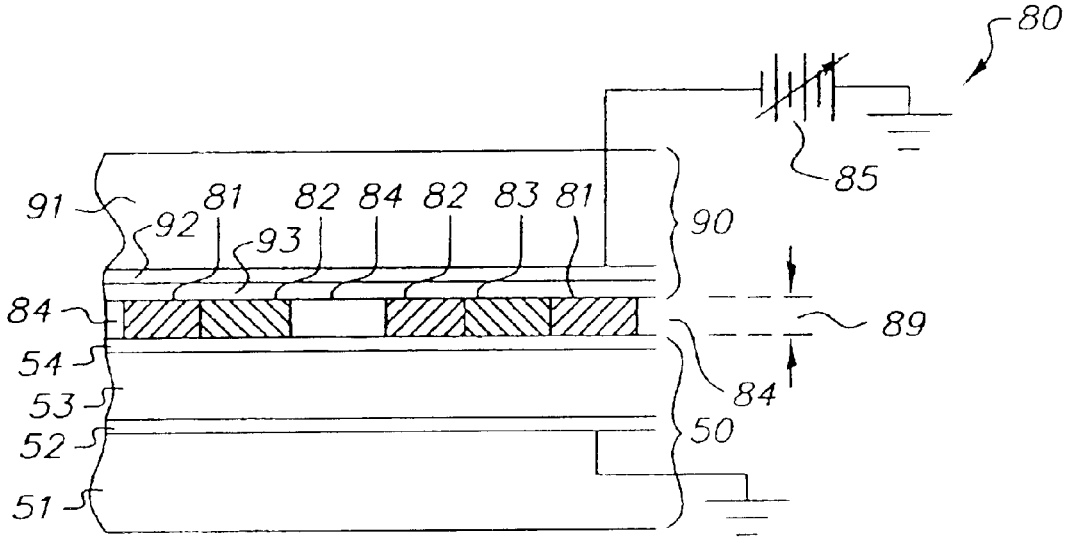
FIG. 6*a* schematically illustrates a side elevational view of an electrocoagulation member and a side elevational view of an intermediate member, which electrocoagulation member and which intermediate member are separated by a gap, which gap is filled by an intermixed electrocoagulable two-fluid primary ink jet ink image corresponding to FIG. 1*c;*

FIG. 6*a* schematically illustrates, in an elevational side view, indicated by the numeral 80, of a portion of apparatus for forming electrocoagulates in a primary image, wherein an electrocoagulation member 90 is included in an electrocoagulation mechanism (entire mechanism not illustrated). Electrocoagulation member 90 is shown in proximity to an intermediate member 50 and separated therefrom by a uniform gap 89. Within the gap 89, and preferably just filling this gap, is a primary image (corresponding to the primary images shown in FIGS. 1*c,d*) which primary image was priorly formed on an intermediate member 50 which has been moved beneath the electrocoagulation member 90. As indicated for the primary image of FIG. 1*d*, the primary image corresponding to FIG. 6*a* is made by an intermixing of droplets of an aqueous-based electrocoagulable marking ink and droplets of an aqueous-based non-marking ink co-deposited so as to form the primary image by ink jet device 21. The non-marking ink contains no electrocoagulable material, is preferably substantially colorless, and is miscible with the electrocoagulable marking ink. All of the pixels of the primary image of FIG. 6*a* preferably have substantially equal volumes, with each pixel containing complementary amounts of the marking and non-marking inks, as previously described above. Thus, the liquid of pixels labeled 84 contain only non-marking ink (corresponding to Dmin) and the pixels labeled 81 contain only marking ink (corresponding to Dmax). The pixels labeled 82 and 83 contain mixtures of the marking and non-marking inks, with pixels 82 containing more marking ink than pixel 83. Thus, increasing amounts of hatching indicate increasing proportions of electrocoagulable marking ink per pixel.

The electrocoagulation member 90 is preferably a rotatable member, e.g., a roller or a web, which rotatable member is held by a positioning device to define the gap 89, which positioning device preferably includes a controller for producing a constant force or pressure against the liquid within the gap. Alternatively, and preferably, a rotatable electrocoagulation member having the form of a roller may be mechanically "floated" on the liquid in the gap, in manner as is done in a conventional off-set printing press. A preferred width of the gap 89 lies in a range of approximately between 5 micrometers and 100 micrometers, although any suitable gap width may be used. Generally speaking, the higher the image resolution (dpi) the smaller the gap. The electrocoagulation member 90 includes an electrode 92 connected to a source 85 of both voltage and current for causing electrocoagulation. The electrode 92 of the electrocoagulation member 90 may be a bare electrode. Alternatively, and preferably, electrode 92 is covered by an electrolytically inert protective layer 93 which is resistant to degradation as might otherwise be caused by passage of current during electrocoagulation. Protective layer 93 preferably has a resistivity of less than $10^4$ ohm-cm, and more preferably, less than $5\times10^2$ ohm-cm. The electrode 92 is adhered to a support 91.

The intermediate member 50 includes a sub-surface electrode 52 sandwiched between a support 51 and a compliant layer 53 (or layers 53), which compliant layer is covered by a protective outer layer 54. It is preferred that the sub-surface electrode 52 be positive with respect to the electrode 92 of the electrocoagulation member 90, which sub-surface electrode is preferably grounded. Such a configuration is preferable when electrocoagulation member 90 has for example the form of an endless web, support 91 then preferably being a flexible material. Alternatively, the sub-surface electrode is positive and is connected to a source (not shown) of both voltage and current while the electrode of the electrocoagulation member may be grounded, and for this configuration electrocoagulation member 90 has for example a preferred form of a roller, the support 91 being a rigid drum preferably made of a metal such as aluminum, and wherein the electrode 92 may in certain embodiments be dispensed with and not included in electrocoagulation member 90. Notwithstanding the above-described preferred biasing, with sub-surface electrode 52 positive with respect to the electrode 92, a reverse polarity in which sub-surface electrode 52 is negative with respect to the electrode 92 may be suitable for certain electrocoagulable ink embodiments. The characteristics of the support 51 and the electrode 52 of intermediate member 50 are respectively otherwise similar to those of the respective layers 41 and 42 of intermediate member 40 in FIG. 5*a*.

Apart from certain different characteristics described below in this paragraph, the properties and dimensions of the layers 53 and 54 of intermediate member 50 are respectively otherwise similar to those of the respective layers 43 and 44 of intermediate member 40 in FIG. 5*a*. In particular, a difference is that each of any compliant layers 53 disposed on the sub-surface electrode preferably has a resistivity of less than 104 ohm-cm, and more preferably, less than $5\times10^2$ ohm-cm. Another difference is that outer layer 54 is selected to be electrolytically inert, i.e., is resistant to degradation as might otherwise be caused by passage of current during electrocoagulation.

Figure 6B:
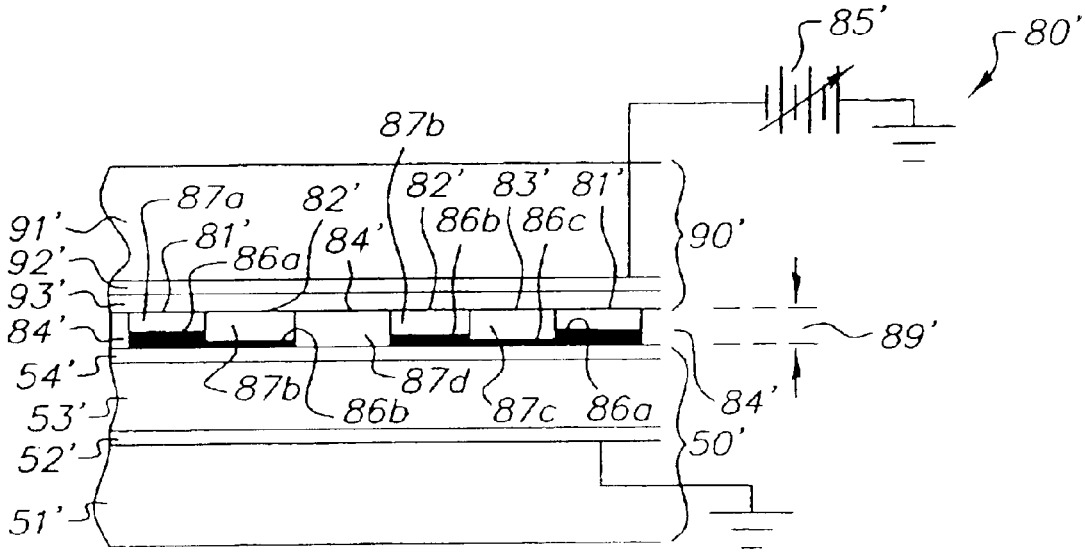
FIG. 6*b* schematically illustrates FIG. 6*a* in more detail, showing an embodiment in which an electrocoagulate image is formed on the operational surface of the intermediate member of FIG. 6*a* by an action of an electric field applied in the gap of FIG. 6*a*, in which embodiment the thickness of the electrocoagulate formed on the operational surface by passage of an electrical current in the gap is in direct proportion to a local amount of colorant in the electrocoagulate image.

The situation after electrocoagulation is shown schematically in FIG. 6*b*, wherein the primed (') entities have the same characteristics and dimensions as the corresponding unprimed entities of FIG. 6*a*. As indicated in FIG. 6*b*, after electrocoagulation is complete, e.g., in pixels respectively labeled 81', 82', and 83', a corresponding respective thickness 86*a,b,c* of marking electrocoagulate material on the surface of layer 54' is greatest for pixel 81', intermediate for pixel 82', and least for pixel 83', while pixel 84' contains no electrocoagulate. These respective thicknesses of electrocoagulate reflect the respective amounts of electrocoagulable material present in the corresponding pixels 81, 82, 83 and 84 of the primary image of FIG. 6*a*, as indicated by the degrees of hatching. The situation shown in FIG. 6*b* obtains before the rotating intermediate member 50' moves the image away from the electrocoagulating member 90' for subsequent removal of the corresponding respective excess amounts 87*a,b,c,d* of liquid, in order to form a liquid-depleted ink-jet-ink-derived electrocoagulate material image on the operational surface of the intermediate member.

For use with an electrocoagulation member it is preferred to use a non-marking ink which is electrocoagulable, rather than a non-marking ink containing no electrocoagulable material as described in reference to FIGS. 6*a,b*. Thus, every pixel of a two-fluid primary image contains a mixture of an amount of a marking electrocoagulable ink, and a complementary amount of a preferred non-marking electrocoagulable ink, as described above with reference to FIG. 1*e*, such that both electrocoagulable inks are co-deposited on the operational surface of the intermediate member as the first and second inks by the ink jet device 21. Thus, by analogy and with further reference to FIG. 6*a*, each pixel of the primary image in this preferred embodiment contains a complementary volume of non-marking electrocoagulable ink, in addition to the non-marking electrocoagulable ink (not separately illustrated prior to electrocoagulation). Except that electrocoagulates made from the non-marking electrocoagulable ink contain no colorant material, the non-marking electrocoagulable ink is preferably otherwise similar to the marking electrocoagulable ink, and more preferably, identical in nature to the marking electrocoagulable ink (except for any added colorant material). In a primary image using this preferred non-marking ink, a Dmax pixel, e.g., corresponding to a pixel 81 in FIG. 6*a*, contains no amount of the non-marking electrocoagulable ink. Similarly, a Dmin pixel, e.g., corresponding to a pixel 84 in FIG. 6*a*, contains no amount of the non-marking electrocoagulable ink, and an intermediate density pixel, corresponding to a pixel 82 or 83, contains an admixture of the two electrocoagulable inks. In each of the pixels included in the primary image, the volume of liquid per pixel is preferably substantially the same.

Figure 6C:
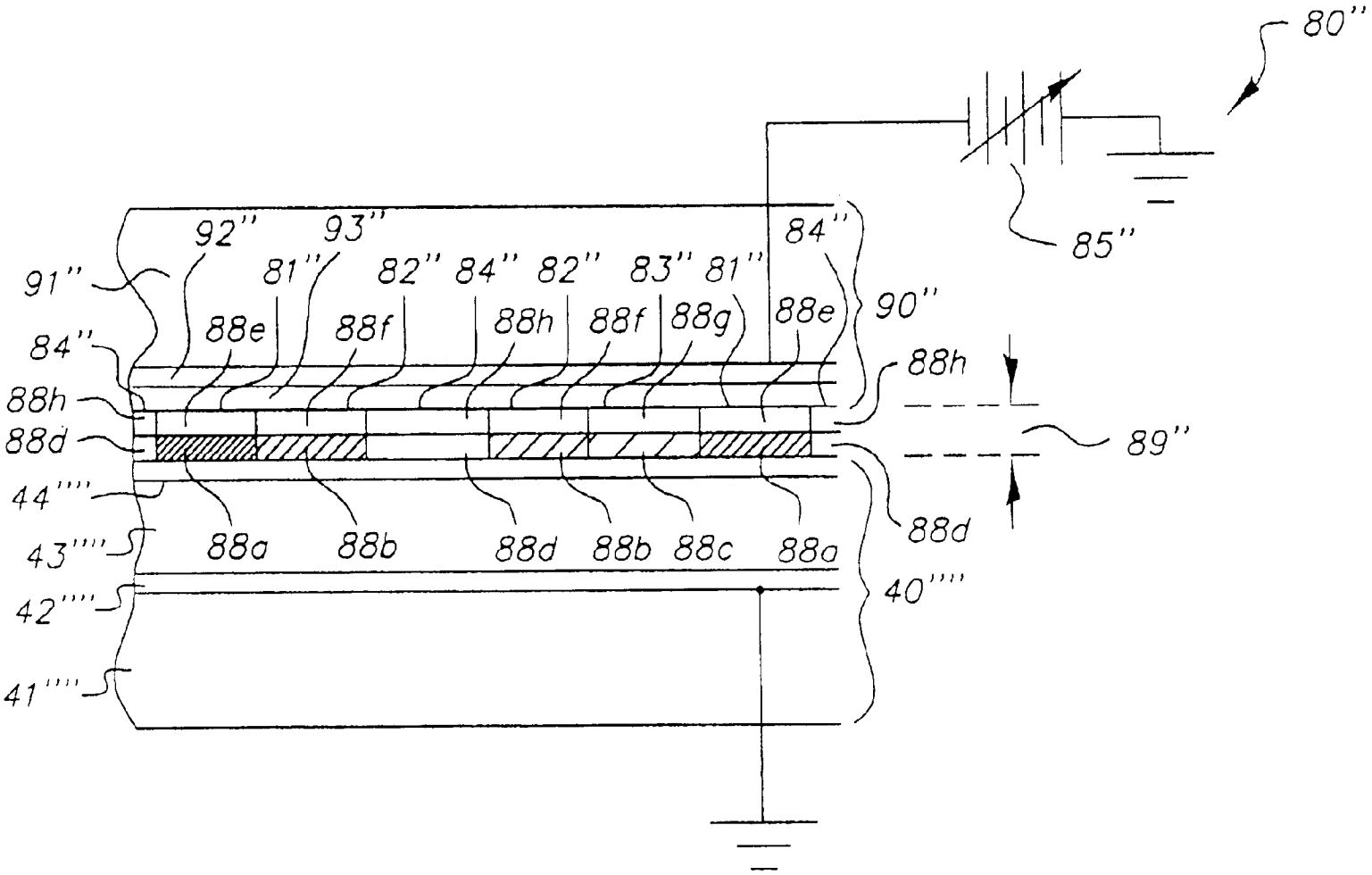
FIG. 6*c* schematically illustrates FIG. 6*a* in more detail, showing an alternative embodiment in which an electrocoagulate image is formed on the operational surface of the intermediate member of FIG. 6*a* by an action of an electric field applied in the gap of FIG. 6*a*, in which alternative embodiment the primary image contains variable amounts of an electrocoagulable colorant component and a predetermined amount of an electrocoagulable colorless component, such that the total thickness formed on the operational surface by passage of an electrical current in the gap is substantially uniform, which total thickness includes the electrocoagulable colorant component of the electrocoagulate and the electrocoagulable colorless component of the electrocoagulate.

After electrocoagulation, the situation is shown in FIG. 6*c*, wherein double primed (") entities correspond entirely to the unprimed entities in FIG. 6*a*. In pixels where both marking and non-marking electrocoagulable inks were present in the primary image, colored co-electrocoagulates are produced. As indicated in FIG. 6*c*, after electrocoagulation is complete, e.g., in pixels respectively labeled 81", 82", 83", and 84" a corresponding coloration or optical density, as indicated by the degrees of cross-hatching, of a corresponding respective electrocoagulate layer 88*a,b,c,d*, is greatest for a pixel 81", less for a pixel 82", and least for a pixel 83", while the electrocoagulate in a pixel 84" is uncolored being made entirely from the non-marking electrocoagulable ink. The respective thicknesses of electrocoagulate in each pixel is preferably substantially the same, reflecting preferred respective complementary amounts of the marking and non-marking electrocoagulable inks present in the corresponding pixels of the primary image. Similarly, the volumes of exhausted liquid 88*e,f,g,h* above each of the respective electrocoagulate layers is preferably substantially the same. The situation shown in FIG. 6*b* obtains before the rotating intermediate member 50' moves the image away from the electrocoagulating member 90' for subsequent removal of the corresponding respective excess amounts 87*e,f,g,h* of liquid, in order to form a liquid-depleted ink-jet-ink-derived electrocoagulate material image on the operational surface of the intermediate member. Owing to the advantageous fact that the amounts 87*e,f,g,h* of excess liquid per pixel are substantially the same for all pixels, it will be generally easier for these amounts of liquid to be efficiently removed, e.g., in an Excess Liquid Removal Process Zone 23, than would be the case for the nonuniform amounts of excess liquid 87*a,b,c,d* in FIG. 6*b*.

It will be especially noted that, for the preferred situation wherein any thickness of an electrocoagulate layer containing any proportion of pigmented and unpigmented particles is substantially the same, the resulting efficiency of transfer to a receiver will generally be much more uniform and complete than for the varyingly thick electrocoagulate layers such as in pixels 81', 82', 83', and 84' in FIG. 6*b*. Moreover, it will be evident that after transfer to the receiver of any ink-jet-ink-derived material image formed by utilizing the preferred non-marking electrocoagulable ink, the resulting unfused image quality will be superior as compared to utilizing a non-marking ink containing no electrocoagulable material. The improved image quality results from the more uniform transfer of the resulting liquid-depleted image, including a more efficient transfer of the material in the lower density pixels. Following any subsequent fusing of the resulting ink-jet-ink-derived material image to the receiver, the resulting image quality will be superior as compared to that obtained by using a non-marking ink containing no electrocoagulable material, i.e., the gloss will be much more uniform. Also, a perceived image mottle, such as caused by a nonuniform thickness of the ink-jet-ink-derived material image produced by using the previous embodiment, will be much reduced. It should be noted that the physical properties of the non-marking particles of the preferred non-marking ink can be advantageously tailored, e.g., for improved fusing and improved gloss of an ink-jet-ink-derived material image on a receiver. Moreover, in conjunction with use of a non-contacting electrode device in the Coagulate Formation Process Zone 22, it can be advantageous to deliver from the ink jet device 21 to each pixel of a primary image an extra number of droplets of the non-marking unpigmented particulate ink, for further improvements of fusing and image gloss properties after subsequent transfer of the corresponding liquid-depleted image to the receiver.

Any suitable marking electrocoagulable ink or non-marking electrocoagulable ink may be used. Such an electrocoagulable ink may form electrocoagulates or co-electrocoagulates of any pre-selected color, including a substantially colorless electrocoagulate such as in a pixel containing no marking electrocoagulable ink, e.g., as shown in FIG. 6*c*. Electrocoagulates, produced by passage of electrical current through the liquid included in a primary image spontaneously form an electrocoagulated layer in direct contact with the operational surface, which electrocoagulated layer is located below a residual layer of excess liquid exhausted of electrocoagulable components, as illustrated in FIGS. 6*b,c*.

In yet other embodiments of the invention (not illustrated), alternative mechanisms other than electric field mechanisms are used to cause formation of coagulates in the Coagulate Process Formation Zone 22. As for certain previous embodiments described above, in certain of these yet other embodiments one of the first and second inks used in the ink jet device 21 is a marking ink, which marking ink is preferably a dispersion of colored, preferably pigmented, particles in a carrier liquid, the other ink containing no particles and preferably being otherwise similar to the carrier liquid of the marking ink. However, in preferred embodiments of these yet other embodiments, both the first and second inks are dispersions of particles in a respective carrier liquid, one of the inks being a dispersion of marking particles which particles are preferably pigmented particles, and the other ink being a dispersion of non-marking, preferably colorless, unpigmented, particles. In these preferred yet other embodiments, an amount of coagulated material produced from each pixel of the primary image in the Coagulate Process Formation Zone 22 is preferably substantially uniform for all pixels of an image, which amount includes imagewise varying complementary amounts of both marking and non-marking particles, wherein some pixels contain only marking particles and some pixels contain only non-marking particles, as fully described above for previous embodiments. To cause formation of coagulates in a primary image by any of the alternative mechanisms described below, complementary volumes of the marking and non-marking inks are co-deposited by the ink jet device 21 so as to preferably produce substantially the same total volume of liquid in each pixel of the primary image, wherein some pixels contain only the marking ink and some pixels contain only the non-marking ink. These alternative mechanisms for forming coagulates in a primary image include mechanisms for forming coagulates as disclosed in the above-referenced related co-pending U.S. patent application Ser. No. 09/973,244 filed on even date herewith in the names of John W. May, et al. The term "coagulate", as used hereafter in the following descriptions of these alternative mechanisms, includes flocs, aggregates, or agglomerates.

One alternative mechanism for inducing formation of coagulates in a primary image is a salt donation mechanism, wherein a dissolved salt including a multivalent cation or anion is introduced into the liquid of the primary image, which primary image priorly includes an electrostatically stabilized aqueous-based ink dispersion of particles. For introducing the multivalent salt as a solution, the salt donation mechanism may include a sponge, a squeegee blade, a spray device, or a secondary ink jet device for depositing on each pixel of the primary image at least a critical amount of the salt solution for causing coagulates to form. Salts of divalent cations may include inorganic salts of $Mg^{+2}$, $Ca^{+2}$, $Mn^{+2}$, $Ni^{+2}$, $Co^{+2}$, $Cu^{30\ 2}$, $Zn^{+2}$, and so forth. It is especially preferred to use salts of trivalent cations, including inorganic salts of $Al^{+3}$, $Fe^{+3}$, $Ce^{+3}$, and so forth, or quadrivalent ions such as $Ce^{+4}$, $Zr^{+4}$, and so forth. Salts of divalent anions may include $SO_4^{-2}$, $CO_3^{-2}$, and so forth. It is especially preferred to use salts of trivalent anions, including inorganic salts of $Fe(CN)_6^{-3}$, $PO_4^{-3}$, and so forth. A multivalent salt may be added to a primary image after formation of the primary image, or it may be applied to the operational surface of the intermediate member, i.e., prior to forming the primary image and after regenerating the operational surface in the Regeneration Process Zone 25.

Another alternative mechanism for inducing formation of coagulates in a primary image is a pH-altering donation mechanism for introducing a pH-altering material to the solution of the primary image, which primary image includes an electrostatically stabilized aqueous-based ink dispersion of particles. When the particles included in the primary image are negatively charged, an acidic solution is introduced by the pH-altering donation mechanism for causing formation of coagulates, and conversely, a basic solution is introduced if the particles are positively charged. Preferably, at least a critical amount of pH-altering solution is added to each pixel of the primary image, which critical amount produces a condition known as the point of zero charge (pzc), thereby causing destabilization of the dispersion and formation of coagulates. The pH-altering donation mechanism includes a sponge, a squeegee blade, a spray device, or a secondary ink jet device for depositing on each pixel of the primary image at least a corresponding critical amount of the pH-altering solution. A pH-altering material may be added to a primary image after formation of the primary image, or it may be applied to the operational surface of the intermediate member, i.e., prior to forming the primary image and after regenerating the operational surface in the Regeneration Process Zone 25.

Yet another alternative mechanism for inducing formation of coagulates in a primary image is a non-solvent donation mechanism for introducing into a primary image a critical quantity of a non-solvent liquid, which non-solvent is miscible with the liquid of the primary image. Prior to any addition of the non-solvent liquid, the primary image includes either a nonaqueous or an aqueous-based sterically stabilized ink dispersion of particles, which particles are stabilized by polymeric moieties bonded or adsorbed to the surfaces of the particles and which moieties include extended chain portions which are compatible with and are solubilized by the liquid in which the particles are dispersed. The non-solvent liquid may be a nonaqueous liquid or an aqueous-based liquid. The non-solvent liquid, which is miscible with the liquid of the primary image in which the particles are dispersed, is not compatible with the polymeric moieties. By using the non-solvent donation mechanism to add at least a critical amount of the non-solvent liquid, the extended chain portions of the polymeric moieties change their configurational shapes from extended shapes to tight conformations, allowing interparticle van der Waals or dispersion forces to act so as to rapidly cause formation of flocs or coagulates. The non-solvent donation mechanism includes a sponge, a squeegee blade, a spray device, or a secondary ink jet device for depositing on each pixel of the primary image at least a corresponding critical amount of the non-solvent liquid. A non-solvent liquid may be added to a primary image after formation of the primary image, or it may be applied to the operational surface of the intermediate member, i.e., prior to forming the primary image and after regenerating the operational surface in the Regeneration Process Zone 25.

Still yet another alternative mechanism for inducing formation of coagulates in a primary image is a denuding agent mechanism for at least partially destroying, debonding, or desorbing sterically stabilizing polymeric moieties bound to the surfaces of a sterically stabilized dispersion of ink particles included in a primary image. The resulting comparatively unshielded or denuded particles are no longer protected by steric stabilization, and are subject to formation of coagulates as a result of their mutual attractions caused by van der Waals or dispersion forces between them. The denuding agent mechanism preferably includes a source of radiation, e.g., which radiation is selectively absorbed by the polymeric moieties, thereby causing a heating or a photochemical reaction for cleaving or destroying the polymeric chains of the sterically stabilizing moieties. Any other suitable denuding mechanism may be used.

A further alternative mechanism for inducing formation of coagulates is a temperature-altering mechanism for a heating or a cooling of the primary image, which primary image includes an aqueous-based or a nonaqueous particulate ink dispersion having steric stabilization. A choice of heating or cooling by the temperature-altering mechanism is determined by the relative magnitudes of the enthalpy and entropy contributions to the free energy of close approach of sterically stabilized particles in the primary image. When the dispersion is stabilized by enthalpic stabilization (more typical for aqueous-based dispersions) the temperature-altering mechanism heats the primary image to cause formation of flocs or coagulates. Conversely, when the dispersion is stabilized by entropic stabilization (more typical for nonaqueous dispersions) the temperature-altering mechanism cools the primary image to cause formation of flocs or coagulates. The temperature-altering mechanism includes: a source of radiant energy for heating, e.g., infrared radiation; a source of heat located within the intermediate member; an external contacting heated member; a source for cooling located within the intermediate member, such as a Peltier effect cooling device; a coolant circulated in conduits of a coolant circulating system; or an external contacting cooling member. Any suitable temperature-altering mechanism may be used.

A still further alternative mechanism for inducing formation of coagulates is a hetero-colloid donation mechanism for addition of a hetero-colloid liquid to a primary image. The primary image includes an ink dispersion of charged particles plus corresponding counterions distributed within the liquid of the dispersion. The hetero-colloid liquid is a colloidal dispersion of charged particles having a polarity opposite to a polarity of the charged particles of the primary image. After addition of hetero-colloid liquid to the primary image, electrostatic attractions between the oppositely charged particles of the ink particles and the hetero-colloid particles causes hetero-coagulates to be formed. Preferably, the primary image dispersion and the hetero-colloid liquid are mutually miscible. Particles of the hetero-colloid preferably provide any useful function, e.g., enhancing the transferability of the hetero-coagulates to a receiver, or improving in a fusing station the fusibility of an image previously transferred to a receiver. The hetero-colloid donation mechanism includes a sponge, a squeegee blade, a spray device, and a secondary ink jet device for depositing on each pixel of the primary image at least a corresponding critical amount of the hetero-colloid for inducing formation of coagulates. A hetero-colloid liquid may be added to a primary image after formation of the primary image, or it may be applied to the operational surface of the intermediate member, i.e., prior to forming the primary image and after regenerating the operational surface in the Regeneration Process Zone 25.

Yet a still further alternative mechanism for inducing formation of coagulates is a polymer-solution-donation mechanism for introducing a polymeric material which is compatible with the liquid of a primary image so as to induce a depletion flocculation in the primary image. The polymeric material is preferably dispersed as a colloid in a fluid (or dissolved in a fluid) for addition to a primary image, which polymeric material is not adsorbed by the ink particles dispersed in the primary image liquid. The fluid is preferably miscible with the liquid of the primary image, which includes an electrostatically stabilized dispersion of particles. The polymer-solution-donation mechanism includes a sponge, a squeegee, a spray device, and a secondary ink jet device for depositing on each pixel of the primary image at least a corresponding critical amount of the polymeric material for inducing depletion flocculation. The polymer material may be added to a primary image after formation of the primary image, or it may be applied to the operational surface of the intermediate member, i.e., prior to forming the primary image and after regenerating the operational surface in the Regeneration Process Zone 25. Following a formation of coagulates in a primary image by an alternative mechanism for inducing formation of coagulates as described above, excess liquid is removed in the Excess Liquid Removal Process Zone 23 by any suitable device, and the resulting liquid-depleted ink-jet-ink-derived material images transferred to a receiver by a suitable transfer mechanism in Transfer Process Zone 24.

Notwithstanding disclosure hereinabove relating to rotatable intermediate members, an intermediate member may in certain other embodiments be a linearly-movable planar member, e.g., in the form of a plate or a platen, or, the intermediate member may be mounted on a plate or a platen. In an imaging apparatus including a planar intermediate member, the planar intermediate member is moved along a linear path past various devices or process zones having characteristics similar to those described above with reference to FIG. 2, which devices or process zones are disposed along a direction of motion of the plate or platen. Thus, in an apparatus which includes a linearly-movable planar intermediate member, the devices or process zones can be disposed sequentially in the following order: an ink jet device similar to that of FIG. 2; a Coagulate Formation Process Zone; an Excess Liquid Removal Process Zone; a Transfer Process Zone; and, a Regeneration Process Zone, wherein the ink jet device is located near a starting position for ultimately forming an image on a receiver provided in the Transfer Process Zone, and the Regeneration Process Zone is located after the Transfer Process Zone near an ending position along the direction of motion. Alternatively, the Regeneration Process Zone may be located near a starting position and the Transfer Process Zone located near the ending position. After the platen reaches the ending position, the direction of the platen is reversed and the platen is moved back to the starting position.

The present invention has certain advantages over the inventions disclosed in related copending U.S. patent application Ser. No. 09/973,239, entitled Ink Jet Process Including Removal Of Excess Liquid From An Intermediate Member by Arun Chowdry, et al., and related copending U.S. patent application Ser. No. 09/973,244, now U.S. Pat. No. 6,682,189 entitled Ink Jet Imaging Via Coagulation On An Intermediate Member by John W. May, et al. An important feature of the present invention is that a substantially constant volume of liquid is preferably deposited in each pixel of a primary image by the ink jet device, which liquid includes at least one of the marking and non-marking inks. By comparison with art wherein only marking ink is used to form a primary image, in the present invention problems are much reduced relating to image spreading during formation of the primary image by the ink jet device. Similarly, by comparison with other art wherein only marking ink is used to form a primary image, problems are much reduced relating to image spreading during the removal of excess liquid (prior to transfer of an ink-jet-ink-derived material image to a receiver). When only one ink is used, different pixels of a primary image contain variable numbers of droplets, and there is a problem of sideways squashing of the liquid in those pixels containing larger volumes ink when a contacting device is used to remove the excess liquid, resulting in reduced image sharpness and resolution. In relation to these problems, the present invention is advantageously not as dependent on surface energies and spreading coefficients to maintain image integrity against image spreading. Moreover, because each pixel of the primary image contains preferably substantially the same volume of liquid, it is easier to provide a uniform spacing for a noncontacting electrode or to provide a more uniform current density in an electrocoagulable primary image. In preferred embodiments in which the non-marking ink is a dispersion of preferably colorless or unpigmented particles, it is easier to remove excess liquid using a contacting excess liquid removal device, inasmuch as an amount of excess liquid is preferably substantially the same in each pixel after coagulates have been formed. Similarly, in preferred electrocoagulation embodiments in which the non-marking ink is made of a preferably colorless or unpigmented electrocoagulable material, it is easier to remove excess liquid using a contacting excess liquid removal device, inasmuch as an amount of excess liquid is preferably substantially the same in each pixel after electrocoagulates have been formed. Moreover, when the non-marking ink is either a dispersion of colorless or unpigmented particles, or alternatively when the non-marking ink is made of a preferably colorless or unpigmented electrocoagulable material, transfer of the corresponding liquid-depleted ink-jet-ink-derived material to a receiver or to another member is advantageously more uniform and more complete. As a result of such more uniform transfer, a resulting image on a receiver will have superior gloss characteristics after fusing, thereby providing a customer with more attractive prints.

The invention has been described in detail with particular reference to certain preferred embodiments thereof, but it will be understood that variations and modifications can be effected within the spirit and scope of the invention.

What is claimed is:

1. For forming an ink-jet-ink-derived material image on an operational surface of a member and transferring said ink-jet-ink-derived material image to a receiver member, an imaging apparatus comprising:

an ink jet device including a first source of a first ink having a liquid phase and a second source of a second ink having a liquid phase, said ink jet device adapted to provide imagewise jetting, on to said operational surface, droplets of said first ink from said first source and droplets of said second ink from said second source, thereby forming on said operational surface of said member a primary image including at least the liquid phase of at least one of said first ink and said second ink;

a plurality of process zones associated with said operational surface of said member, said plurality of process zones located sequentially in proximity with said operational surface, and said plurality of process zones including a coagulate formation process zone, an excess liquid removal process zone, and a transfer process zone;

in said coagulate formation process zone, a coagulate forming mechanism for causing a formation of coagulates within a liquid phase of said primary image;

in said excess liquid removal process zone, a liquid removal mechanism for removing from said coagulates a portion of said liquid phase to form on said operational surface a liquid-depleted image; and in said transfer process zone, a transfer mechanism for transferring, to a receiver member from said operational surface, said liquid-depleted image;

wherein one of said first ink and said second ink is a coagulable marking ink and the other of said first ink and said second ink is a non-marking ink, said marking ink and said non-marking ink being mutually miscible in said primary image; and wherein said primary image includes a plurality of smallest resolved imaging areas, each of said plurality of smallest resolved imaging areas having received, from said ink jet device, a preselected number of droplets of said first ink and a complementary preselected number of droplets of said second ink, said preselected number including zero and said complementary preselected number including zero.

2. The apparatus according to claim 1, further comprising:

a regeneration process zone included in said plurality of process zones, said regeneration process zone associated in proximity with said operational surface of said member at a location between said transfer zone and said ink jet device; and wherein said regeneration process zone is provided with a mechanism for regenerating said operational surface, said regenerating preceding a subsequent formation by said ink jet device of a new primary image.

3. The apparatus according to claim 2, wherein said regenerating mechanism for regenerating said operational surface comprises at least one of a group consisting of a cleaning blade, a squeegee, a scraper for scraping said operational surface, a cleaning roller, a cleaning brush, a solvent applicator, and a wiper.

4. The apparatus according to claim 1, wherein each of said plurality of smallest resolved imaging areas receives, prior to receiving any droplets of said complementary preselected number of droplets of said non-marking ink, a fraction of said preselected number of droplets of said marking ink, said fraction including zero and one.

5. The apparatus according to claim 1, wherein each of said plurality of smallest resolved imaging areas receives a fraction of said preselected number of droplets of said non-marking ink, said fraction including zero and one, prior to receiving any droplets of said complementary preselected number of droplets of said marking ink.

6. The apparatus according to claim 1, wherein, in each of said plurality of smallest resolved imaging areas included in said primary image, a sum of said preselected number of droplets and said complementary preselected number of droplets is substantially equal to a preselected total number of droplets.

7. The apparatus according to claim 1, wherein, in each of said plurality of smallest resolved imaging areas included in said primary image, a mixed volume, resulting from a mixing on said operational surface of all of said preselected number of droplets with all of said complementary preselected number of droplets, is substantially equal to a preselected mixed volume.

8. The apparatus according to claim 1, wherein said coagulable marking ink is a dispersion made of pigmented particles dispersed in a carrier liquid, said non-marking ink including substantially no dispersed particles and said non-marking ink made from a liquid similar to said carrier liquid.

9. The apparatus according to claim 8, wherein said pigmented particles are charged particles, and wherein counterion species having a polarity opposite to a polarity of said charged particles are dispersed in said carrier liquid.

10. The apparatus according to claim 9, wherein said coagulate forming mechanism for causing a formation of coagulates in said coagulate formation process zone is an electric field mechanism, which electric field mechanism is selected from the group consisting of:

a corona charging device;

a contacting device including an electrode; and a non-contacting device including an electrode.

11. The apparatus according to claim 10, wherein said electric field mechanism is a corona charging device, and wherein said corona charging device provides corona ions of a same polarity as a polarity of said particles dispersed in said carrier fluid, which ions are directed towards said primary image to charge said primary image.

12. The apparatus according to claim 10, wherein said electrode has a same polarity as a polarity of said particles dispersed in said carrier fluid.

13. The apparatus according to claim 8, wherein said pigmented particles for inclusion in a marking ink comprises a finely divided pigment dispersed in a binder.

14. The apparatus according to claim 8, wherein said coagulate forming mechanism comprises: a salt donation mechanism, for introducing into said liquid phase of said primary image a dissolved salt, said salt including at least one of a multivalent cation and a multivalent anion.

15. The apparatus according to claim 8, wherein said coagulate forming mechanism comprises: a pH-altering donation mechanism for introducing a pH-altering material into said liquid phase of said primary image, said dispersion of pigmented particles and said dispersion of unpigmented particles being electrostatically stabilized aqueous-based dispersions.

16. The apparatus according to claim 8, wherein said coagulate forming mechanism comprises: a non-solvent donation mechanism for introducing into said liquid phase of said primary image a non-solvent liquid, which non-solvent liquid is miscible with said liquid phase, wherein in said marking ink and said non-marking ink, said respective pigmented particles and said respective unpigmented particles are respectively sterically stabilized by respective polymeric moieties respectively attached to said pigmented particles and said unpigmented particles, which respective polymeric moieties attached to said respective pigmented particles and said respective unpigmented particles are incompatible with said non-solvent liquid, such that said respective polymeric moieties respectively change configurational shapes from extended shapes to tight conformations after an addition of said non-solvent, thereby causing coagulates to form.

17. The apparatus according to claim 8, wherein said coagulate forming mechanism comprises: a hetero-colloid donation mechanism for introducing into said primary image a hetero-colloid liquid, which hetero-colloid liquid and said liquid phase are mutually miscible.

18. The apparatus according to claim 8, wherein said coagulate forming mechanism comprises: a polymer-solution-donation mechanism for introducing, into said liquid phase of said primary image, a polymeric material to induce a depletion flocculation, said polymeric material being compatible with said liquid phase of said primary image.

19. The apparatus according to claim 8, wherein said coagulate forming mechanism comprises: a denuding agent mechanism for causing in said primary image at least one of a desorbing, a debonding, and a partial destroying of sterically stabilizing polymeric moieties bound to surfaces of sterically stabilized particles of said first ink and said second ink, said denuding mechanism including a source of radiation selectively absorbed by said polymeric moieties.

20. The apparatus according to claim 8, wherein said coagulate forming mechanism comprises: a temperature-altering mechanism for altering the temperature of a primary image, which temperature-altering mechanism includes a heating of said primary image when said marking ink and said non-marking ink are stabilized by an enthalpic stabilization, and which temperature-altering mechanism includes a cooling of said primary image when said marking ink and said non-marking ink are stabilized by an entropic stabilization.

21. The apparatus according to claim 1, wherein said coagulable marking ink is a dispersion made of pigmented particles dispersed in a first carrier liquid, and said non-marking ink is a coagulable ink made of a dispersion of unpigmented particles in a second carrier liquid.

22. The apparatus according to claim 21, wherein said pigmented particles are charged particles and said unpigmented particles are charged particles, said pigmented particles and said unpigmented particles having a same polarity, wherein a plurality of first counterion species having a polarity opposite to said same polarity are dispersed in said first carrier liquid and a plurality of second counterion species having a polarity opposite to said same polarity are dispersed in said second carrier liquid.

23. The apparatus according to claim 22, wherein said coagulate forming mechanism for causing a formation of coagulates in said coagulate formation process zone is an electric field mechanism, which electric field mechanism is selected from the group consisting of:

a corona charging device;

a contacting device including an electrode; and a non-contacting device including an electrode.

24. The apparatus according to claim 23, wherein said corona charging device provides corona ions of a same polarity as said same polarity of said pigmented particles and said unpigmented particles, which ions are directed towards said primary image to charge said primary image.

25. The apparatus according to claim 23, wherein said electrode has a same polarity as said same polarity of said pigmented particles and said unpigmented particles.

26. The apparatus according to claim 23, wherein said electric field mechanism is a corona charging device, and wherein said mechanism for removing a portion of said liquid phase in said excess liquid removal process zone comprises a liquid-removal device, said liquid-removal device including at least one of the group consisting of:

a squeegee roller, a squeegee blade;

a contacting blotting device;

an evaporation device;

a vacuum device;

a skiving device; and an air knife device.

27. The apparatus according to claim 21, wherein said pigmented particles for inclusion in a marking ink comprises a finely divided pigment dispersed in a binder.

28. The apparatus according to claim 21, wherein said coagulate forming mechanism comprises: a salt donation mechanism, for introducing into said liquid phase of said primary image a dissolved salt, said salt including at least one of a multivalent cation and a multivalent anion.

29. The apparatus according to claim 21, wherein said coagulate forming mechanism comprises: a pH-altering donation mechanism for introducing a pH-altering material into said liquid phase of said primary image, said dispersion of pigmented particles and said dispersion of unpigmented particles being electrostatically stabilized aqueous-based dispersions.

30. The apparatus according to claim 21, wherein said coagulate forming mechanism comprises: a non-solvent donation mechanism for introducing into said liquid phase of said primary image a non-solvent liquid, which non-solvent liquid is miscible with said liquid phase, wherein in said marking ink and said non-marking ink, said respective pigmented particles and said respective unpigmented particles are respectively sterically stabilized by respective polymeric moieties respectively attached to said pigmented particles and said unpigmented particles, which respective polymeric moieties attached to said respective pigmented particles and said respective unpigmented particles are incompatible with said non-solvent liquid, such that said respective polymeric moieties respectively change configurational shapes from extended shapes to tight conformations after an addition of said non-solvent, thereby causing coagulates to form.

31. The apparatus according to claim 21, wherein said coagulate forming mechanism comprises: a hetero-colloid donation mechanism for introducing into said primary image a hetero-colloid liquid, which hetero-colloid liquid and said liquid phase are mutually miscible.

32. The apparatus according to claim 21, wherein said coagulate forming mechanism comprises: a polymer-solution-donation mechanism for introducing, into said liquid phase of said primary image, a polymeric material to induce a depletion flocculation, said polymeric material being compatible with said liquid phase of said primary image.

33. The apparatus according to claim 21, wherein said coagulate forming mechanism comprises: a denuding agent mechanism for causing in said primary image at least one of a desorbing, a debonding, and a partial destroying of sterically stabilizing polymeric moieties bound to surfaces of sterically stabilized particles of said first ink and said second ink, said denuding mechanism including a source of radiation selectively absorbed by said polymeric moieties.

34. The apparatus according to claim 21, wherein said coagulate forming mechanism comprises: a temperature-altering mechanism for altering the temperature of a primary image, which temperature-altering mechanism includes a heating of said primary image when said marking ink and said non-marking ink are stabilized by an enthalpic stabilization, and which temperature-altering mechanism includes a cooling of said primary image when said marking ink and said non-marking ink are stabilized by an entropic stabilization.

35. The apparatus according to claim 1, wherein said marking ink is an electrocoagulable ink and said non-marking ink includes substantially no electrocoagulable material.

36. The apparatus according to claim 1, wherein said marking ink is an electrocoagulable ink and said non-marking ink is an electrocoagulable ink.

37. The apparatus according to claim 1, wherein said first ink and said second ink are nonaqueous inks.

38. The apparatus according to claim 37, wherein said nonaqueous inks have a flash point greater than or equal to about 140° F.

39. The apparatus according to claim 1, wherein said first ink and said second ink are aqueous-based inks.

40. The apparatus according to claim 1, wherein said member is a rotatable intermediate member.

41. The apparatus according to claim 40, wherein said ink jet device forms a half-tone primary image on said intermediate member.

42. The apparatus according to claim 40, wherein said ink jet device forms a continuous tone primary image on said intermediate member.

43. The apparatus according to claim 1, wherein said member is a linearly-movable intermediate member.

44. The apparatus according to claim 1, wherein at least one of said first ink and said second ink comprises a colloidal dispersion being characterized by at least one of a steric stabilization and an electrostatic stabilization.

45. The apparatus according to claim 1, wherein said member is an intermediate member, which comprises:

a support;

a compliant layer formed on said support;

an thin outer layer formed on said compliant layer; and wherein said support includes one of a drum, a web, and a planar linearly-movable member.

46. The apparatus according to claim 45, wherein said thin outer layer is made from a group of materials including ceramers, and polyurethanes.

47. The apparatus according to claim 1, wherein said member is an intermediate member, which comprises an electrode biasable by a source of potential including ground potential.

48. The apparatus according to claim 1, wherein said transfer mechanism for transferring includes at least one of the group consisting of an electrostatic transfer mechanism, a thermal transfer mechanism, and a pressure transfer mechanism.

49. A digital imaging machine for generating a multicolor ink-jet-ink-derived material image, said digital imaging machine including a plurality of modules arranged sequentially, each module respectively comprising:

an ink jet device for imagewise jetting, on to an operational surface of an intermediate member, droplets of a coagulable marking ink and droplets of a non-marking ink, said ink jet device thereby forming on said operational surface of said intermediate member a primary image;

a plurality of process zones associated with said operational surface of said intermediate member, said plurality of process zones located sequentially in proximity with said operational surface, said plurality of process zones including a coagulation formation process zone, an excess liquid removal process zone, a transfer process zone, and a regeneration process zone;

a coagulate forming mechanism in said coagulation formation process zone for causing formation of coagulates in a liquid phase of said primary image;

a liquid removing mechanism for removing a portion of said liquid phase in said excess liquid removal process zone to form on said operational surface a respective liquid-depleted image;

a transport for moving a receiver sequentially through said each module;

a transfer mechanism for transferring said liquid-depleted image to said receiver from said operational surface in said transfer process zone; and a regeneration mechanism for forming on said operational surface a regenerated operational surface for a subsequent formation thereon, by said ink jet device, of a new primary image, said regeneration process zone associated in proximity with said intermediate member at a location between said transfer process zone and said ink jet device;

wherein said primary image includes a plurality of smallest resolved imaging areas, each of said plurality of smallest resolved imaging areas receiving, from said ink jet device, a preselected number of droplets of said first ink and a complementary preselected number of droplets of said second ink, said preselected number of droplets of said first ink and said complementary preselected number of droplets of said second ink mixing to form a predetermined substantially same volume in said each of said plurality of smallest resolved imaging areas, said preselected number including zero and said complementary preselected number including zero;

wherein said intermediate member includes one of the group of a rotatable member and a linearly-movable member;

wherein said primary image formed on said operational surface of said intermediate member, is formed as one of the group of a continuous tone primary image and a half-tone primary image; and wherein a respective color ink-jet-ink-derived material images are successively transferred in register to said receiver in each of said modules included in said plurality of modules, thereby creating said ink-jet-ink-derived material multicolor image on said receiver.

50. A digital imaging machine according to claim 49, wherein said receiver which is moved sequentially through said each module is adhered to a moving transport belt, which transport belt is included in a plurality of transfer nips for transfer of each said liquid-depleted image to said receiver, each said plurality of transfer nips being included in said transfer process zone, each said intermediate member having the form of a roller engaged with a backup roller to respectively form each of said plurality of transfer nips.

51. A digital imaging machine according to claim 49, wherein said receiver which is moved sequentially through said each module is adhered to a receiver-transporting roller, which receiver-transporting roller is included in a plurality of respective transfer nips for transfer of said each liquid-depleted image to said receiver, each of said plurality of respective transfer nips being included in a respective transfer process zone.

52. A digital imaging machine according to claim 49, wherein said respective coagulable marking ink includes one of the group of an electrocoagulable ink and a dispersion of pigmented particles dispersed in a carrier liquid, and wherein said non-marking ink includes one of the group: a liquid which substantially contains no particles and no electrocoagulable material, a dispersion of unpigmented particles in a carrier liquid, and an electrocoagulable ink.

53. A digital imaging machine for generating a multicolor ink-jet-ink-derived material image, said digital imaging machine including a plurality of modules arranged sequentially, each module respectively comprising:

an ink jet device for imagewise respectively jetting, on to an operational surface of an intermediate member, droplets of a coagulable marking ink and droplets of a non-marking ink, said ink jet device thereby forming on said operational surface of said intermediate member a primary image;

a plurality of process zones associated with said operational surface of said intermediate member, said plurality of process zones located sequentially in proximity with said operational surface, said respective plurality of process zones including an image concentrating process zone, an excess liquid removal process zone, and a transfer process zone;

a concentrating mechanism for concentrating in said respective image concentrating process zone said particles of said primary image to form a concentrated image on said operational surface from said primary image, said mechanism for concentrating said particles causing said particles to become concentrated adjacent said operational surface;

in said each respective module, a mechanism for removing in said respective excess liquid removal process zone a portion of said carrier liquid from said respective concentrated image to form on said respective operational surface a respective liquid-depleted image;

a common member, which is moved sequentially through each said respective module;

a transfer mechanism for transferring to said common member, from said operational surface in said transfer process zone, said liquid-depleted image such that a color ink-jet-ink-derived material image is successively transferred in registry to said common member in each of said modules included in said plurality of modules, thereby forming a plural image on said common member;

a regeneration mechanism for respectively forming on each said operational surface a regenerated operational surface for a subsequent formation thereon, by said ink jet device, of a new primary image, said regeneration process zone associated in proximity with said intermediate member at a location between said transfer process zone and said ink jet device; and in a plural image pressure transfer nip including said common member, said plural image is transferred by a plural image transfer mechanism to a receiver transported through said plural image pressure transfer nip, thereby creating said ink-jet-ink-derived material multicolor image on said receiver;

wherein said primary image includes a plurality of smallest resolved imaging areas, each of said plurality of smallest resolved imaging areas receiving, from said respective ink jet device, a preselected number of droplets of said first ink and a complementary preselected number of droplets of said second ink, said preselected number of droplets of said first ink and said complementary preselected number of droplets of said second ink mixing to form a predetermined substantially same volume in said each of said plurality of smallest resolved imaging areas, said preselected number including zero and said complementary preselected number including zero;

wherein said common member includes one of a rotatable member and a linearly-movable member;

wherein said intermediate member includes one of a rotatable member and a linearly-movable member; and wherein said primary image, formed on said operational surface of said intermediate member, is formed as one of a continuous tone primary image and a half-tone primary image.

54. A digital imaging machine according to claim 53, wherein said coagulable marking ink includes one of an electrocoagulable ink and a dispersion of pigmented particles dispersed in a carrier liquid, and wherein said non-marking ink includes one of the following: a liquid which substantially contains no particles and no electrocoagulable material, a dispersion of unpigmented particles in a carrier liquid, and an electrocoagulable ink.

55. In a digital imaging apparatus having a tandemly arranged plurality of image forming modules, wherein a plurality of ink-jet-ink-derived images are sequentially made in said plurality of image forming modules for successive transfers in register to a receiver member to form a completed plural image on said receiver member, and wherein each image forming module includes an intermediate member on which an ink-jet-ink-derived image is formed on an operational surface, a method of making said completed plural image comprising the steps of:

forming a primary image on said operational surface of said intermediate member by depositing from an ink jet device droplets of a coagulable marking ink and droplets of a respective non-marking ink;

causing a portion of said carrier liquid from said primary image to be removed to form a liquid-depleted image;

transferring said liquid-depleted images to said receiver member, said transferring done in register atop any liquid-depleted images previously transferred to said receiver member;

in a last said module of said plurality of image forming modules, transferring a last liquid-depleted image to form on said receiver member said completed plural image;

wherein in said step of forming a primary image, said coagulable marking ink includes one of the group of an electrocoagulable ink and a dispersion of pigmented particles dispersed in a carrier liquid, and wherein said non-marking ink includes one of the group of: a liquid which substantially contains no particles and no electrocoagulable material, a dispersion of unpigmented particles in a carrier liquid, and an electrocoagulable ink; and prior to said step of forming a primary image, a step of regenerating said operational surface to prepare said operational surface for receiving a new primary image from said ink jet device.

56. In a digital imaging apparatus having a tandemly arranged plurality of image forming modules, wherein a plurality of ink-jet-ink-derived images are sequentially made in said plurality of image forming modules for sequential transfers in register to a common member to form a plural image on said common member, said plural image for transfer to a receiver member from said common member, and wherein each of said image forming modules includes an intermediate member on which an ink-jet-ink-derived image is formed on an operational surface, a method of making said completed plural image comprising the steps of:

forming a primary image on said operational surface of said intermediate member by depositing from an ink jet device droplets of a coagulable marking ink and droplets of a non-marking ink;

causing a portion of said carrier liquid from said primary image to be removed to form a respective liquid-depleted image;

transferring said liquid-depleted images to said common member, said transferring done in register atop any liquid-depleted image previously sequentially transferred in register to said common member;

after a last said respective liquid-depleted image is transferred in register to said common member to form a full color ink-jet-ink-derived image on said common member, transferring said full color ink-jet-ink-derived image to said receiver member to form said completed plural image thereon;

wherein in said step of forming a primary image, said coagulable marking ink includes one of the group of an electrocoagulable ink and a dispersion of pigmented particles dispersed in a carrier liquid, and wherein said non-marking ink includes one of the following: a liquid which substantially contains no particles and no electrocoagulable material, a dispersion of unpigmented particles in a carrier liquid, and an electrocoagulable ink; and prior to said step of forming a respective primary image, a step of regenerating said respective operational surface to prepare said operational surface for receiving a new primary image from said ink jet device.

57. A method of making an ink-jet-ink-derived image comprising the steps of:

forming an ink image on an operational surface of an intermediate member, said ink image including a coagulable marking ink and a non-marking ink wherein each smallest resolved imaging area of said ink image includes a mixed volume of said coagulable marking ink and said non-marking ink, said mixed volume being substantially equal to a preselected mixed volume;

forming, in said ink image, coagulates in a liquid phase;

removing a portion of said liquid phase from said ink image to form a liquid-depleted ink-jet-ink-derived material image; and transferring said liquid-depleted ink-jet-ink-derived material image from said operational surface to another member.

* * * * *